US011460219B2

(12) United States Patent
Rao

(10) Patent No.: US 11,460,219 B2
(45) Date of Patent: Oct. 4, 2022

(54) DEFLECTOR ROD, AIR OUTLET FRAME ASSEMBLY AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Wei Rao, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 247 days.

(21) Appl. No.: 16/801,896

(22) Filed: Feb. 26, 2020

(65) Prior Publication Data

US 2021/0164688 A1 Jun. 3, 2021

Related U.S. Application Data

(63) Continuation of application No. PCT/CN2019/125719, filed on Dec. 16, 2019.

(30) Foreign Application Priority Data

| | | |
|---|---|---|
| Nov. 29, 2019 | (CN) | 201911200649.7 |
| Nov. 29, 2019 | (CN) | 201922118917.2 |
| Nov. 29, 2019 | (CN) | 201922131057.6 |

(51) Int. Cl.
*F24F 13/14* (2006.01)
*F24F 13/15* (2006.01)

(52) U.S. Cl.
CPC ..... *F24F 13/1426* (2013.01); *F24F 13/15* (2013.01)

(58) Field of Classification Search
CPC ..... F24F 13/1426; F24F 13/15; F24F 13/06; F24F 13/1486; F24F 2013/1473;
(Continued)

(56) References Cited

U.S. PATENT DOCUMENTS 3,680,470 A * 8/1972 Neece ..... F24F 13/15 454/313
6,059,652 A * 5/2000 Terry ..... B60H 1/3428 454/154

(Continued)

*Primary Examiner* — Steven B McAllister
*Assistant Examiner* — Charles R Brawner
(74) *Attorney, Agent, or Firm* — Anova Law Group PLLC

(57) ABSTRACT

A deflector rod includes a linkage member configured to drive a louver of an air outlet frame to rotate and a shift member connected with the end of the linkage member. The linkage member includes a first limiting projection provided at one end of the linkage member. The shift member includes a groove extending between two opposite ends of the shift member and a second limiting projection provided at a side wall of the groove away from the linkage member. Both the second limiting projection and the first limiting projection are spaced apart from a bottom wall of the groove. The groove, the first limiting projection, and the second limiting projection are configured to clamp an air guide bar of the air outlet frame such that the air guide bar is at least partially located in the groove, between the second limiting projection and the bottom wall of the groove, and between the first limiting projection and the bottom wall of the groove.

19 Claims, 15 Drawing Sheets

(58) Field of Classification Search
CPC .. B60H 1/0065; B60H 1/3414; B60H 1/3435; B60H 1/3428; B60H 2001/3471
USPC ..... 454/319, 155
See application file for complete search history.

(56) References Cited

U.S. PATENT DOCUMENTS

| | | | | |
|---|---|---|---|---|
| 6,447,388 | B1 * | 9/2002 | de Barros | F24F 13/065 454/202 |
| 6,494,780 | B1 * | 12/2002 | Norbury, Jr. | F24F 13/06 454/155 |
| 2006/0014485 | A1 * | 1/2006 | Sousa | B60H 1/3421 454/315 |
| 2007/0111653 | A1 * | 5/2007 | Endou | B60H 1/3421 454/155 |
| 2013/0267158 | A1 * | 10/2013 | Noichl | B29C 45/1676 454/155 |
| 2016/0200177 | A1 * | 7/2016 | Uchiyama | B60H 1/3421 454/155 |
| 2016/0229259 | A1 * | 8/2016 | Kwon | B60H 1/3414 |
| 2016/0303942 | A1 * | 10/2016 | Lim | B60H 1/0065 |
| 2017/0240025 | A1 * | 8/2017 | Tian | B60H 1/3421 |
| 2018/0022180 | A1 * | 1/2018 | Lin | B60H 1/0065 454/155 |
| 2018/0099541 | A1 * | 4/2018 | Gareis | B60H 1/3421 |
| 2018/0354338 | A1 * | 12/2018 | Pacher | B60H 1/3421 |
| 2019/0193526 | A1 * | 6/2019 | Stark | F24F 13/15 |

* cited by examiner

A-A

DEFLECTOR ROD, AIR OUTLET FRAME ASSEMBLY AND AIR CONDITIONER

CROSS-REFERENCE TO RELATED APPLICATIONS

This application is a continuation of International Application No. PCT/CN2019/125719, filed on Dec. 25, 2019, which is based on and claims priority to Chinese Patent Applications Serial Nos. 201911200649.7, 201922131057.6, and 201922118917.2, all filed on Nov. 29, 2019, the entire contents of all of which are incorporated herein by reference.

FIELD

The present application relates to the field of air conditioning technologies, and particularly to a deflector rod, an air outlet frame assembly and an air conditioner.

BACKGROUND

In related art, an air outlet frame is provided with a deflector rod configured to adjust a deflection direction of a louver. However, the deflector rod is not connected with the air outlet frame fixedly, and tends to drop down from the air outlet frame.

SUMMARY

The present application seeks to solve at least one of the problems existing in the related art to at least some extent. To this end, the present application proposes a deflector rod connected to an air outlet frame fixedly, which may improve operational reliability of the deflector rod.

The present application also proposes an air outlet frame assembly, including the above-mentioned deflector rod.

The present application also proposes an air conditioner, including the above-mentioned air outlet frame assembly.

The deflector rod according to embodiments of the present application is configured for the air outlet frame. The air outlet frame has an air outlet channel, and the air outlet channel has an air guide bar extending in its length direction, and the air outlet frame is provided with a louver. The deflector rod includes: a linkage member configured to drive the louver to rotate, having one end provided with a first limiting projection; a shift member, connected with one end of the linkage member, and having a groove extending to two opposite ends of the shift member, a second limiting projection being provided at a side wall of the groove away from the linkage member, both the second and first limiting projections being spaced apart from a bottom wall of the groove, and the air guide bar being at least partially located in the groove, and located between the second limiting projection and the bottom wall of the groove and between the first limiting projection and the bottom wall of the groove.

In the deflector rod according to embodiments of the present application, by providing the first limiting projection at the linkage member, providing the second limiting projection at the shift member, and separating the second and first limiting projections from the bottom wall of the groove, after the deflector rod is mounted at the air guide bar, the part of the air guide bar may be limited between the second limiting projection and the bottom wall of the groove and between the first limiting projection and the bottom wall of the groove. Limited by the first and second limiting projections, the air guide bar may be prevented from moving out of the groove, thereby improving the connection strength and reliability between the deflector rod and the air outlet frame.

According to some embodiments of the present application, an end surface of the first limiting projection away from an inner side wall of the groove has a first guide slope, and the first guide slope is inclined away from the linkage member in a direction from an opening of the groove to the bottom wall of the groove.

According to some embodiments of the present application, the deflector rod further includes a connection member, and the connection member has a first end connected with the end of the linkage member proximal to the shift member, and a second end connected with the first limiting projection and extending towards a side away from the bottom wall of the groove.

In some embodiments of the present application, one end of the linkage member proximal to the shift member has a recess, the deflector rod further includes an elastic member, having one end in a length direction connected with a bottom wall of the recess, the other end in the length direction connected with the connection member, and both sides of the elastic member in a width direction are spaced apart from an inner peripheral wall of the recess.

According to some embodiments of the present application, an end surface of the second limiting projection apart from an inner side wall of the groove has a second guide slope, and the second guide slope is inclined close to the linkage member in a direction from an opening of the groove to the bottom wall of the groove.

In some embodiments of the present application, a maximum height H of the second limiting projection ranges from 0.5 mm to 1.5 mm.

According to some embodiments of the present application, a plurality of shift ribs are provided at an outer side wall of the shift member away from the linkage member and are spaced apart from each other.

In some embodiments of the present application, the plurality of the shift ribs are spaced apart from each other in a length direction of the air guide bar, and each of the shift ribs extends in a direction perpendicular to the length direction of the air guide bar.

According to some embodiments of the present application, the linkage member extends in a length direction of the air guide bar, the linkage member is provided with a plurality of accommodation notches, and the plurality of accommodation notches are spaced apart from each other in the length direction of the linkage member.

The air outlet frame assembly according to embodiments of the present application includes: an air outlet frame, having an air outlet channel with an air guide bar extending in a length direction thereof; the above-mentioned deflector rod, at least partially located in the groove, and located between the first limiting projection and a bottom wall of the groove and between the second limiting projection and the bottom wall of the groove; a louver, rotatably provided at the air outlet frame, located upstream of the air guide bar in an air flow direction, one end of the louver proximal to the air guide bar being connected with the other end of the linkage member.

In the air outlet frame assembly according to embodiments of the present application, by providing the first limiting projection at the linkage member, providing the second limiting projection at the shift member, and separating the second and first limiting projections from the groove, after the deflector rod is mounted at the air guide bar, the part of the air guide bar may be limited between the second limiting projection and the bottom wall of the groove and between the first limiting projection and the bottom wall of the groove. Limited by the first and second limiting projections, the air guide bar may be prevented from moving out of the groove, thereby improving the connection strength and reliability between the deflector rod and the air outlet frame.

According to some embodiments of the present application, the air outlet channel is further provided therein with a plurality of reinforcing rib plates, the reinforcing rib plates extending in a width direction of the air outlet channel and being spaced apart from each other in a length direction of the air outlet channel, and the air guide bar being connected with the plurality of the reinforcing rib plates.

According to some embodiments of the present application, a plurality of air guide bars are provided, and are spaced apart from each other in the width direction of the air outlet channel.

According to some embodiments of the present application, two ends of the air outlet frame in the width direction have a first mounting member and a second mounting member respectively, the first mounting member includes a first notch and a mounting rib located in the first notch, the first notch is located at an air inlet end of the air outlet frame, the mounting rib is provided in the first notch, two ends of the mounting rib in the length direction are connected with two opposite inner side walls of the first notch respectively, the rest part of the mounting rib is spaced apart from the inner wall of the first notch, a mounting hole configured to mount the louver is formed at the mounting rib and has a mounting notch, the louver has a first rotation member and a second rotation member, the first rotation member is located in the mounting hole, and the second rotation member is fitted with the second mounting member.

According to some embodiments of the present application, a width of at least a portion of the mounting hole adjacent to the mounting notch is decreased gradually.

In some embodiments of the present application, in a direction toward the mounting notch, the width of the mounting hole is increased and then decreased gradually.

In some embodiments of the present application, the first notch includes a first sub-notch formed at the air inlet end of the air inlet frame and a second sub-notch formed at a bottom wall of the first sub-notch, a maximum width of the second sub-notch is less than a minimum width of the first sub-notch, the mounting rib includes a first segment, a second segment and a third segment which are connected successively, the second segment is opposite to the second sub-notch, the mounting hole is formed at the second segment, one end of the first segment and one end of the third segment are connected with two ends of the second segment in the length direction respectively, the other end of the first segment and the other end of the third segment are connected with two opposite inner side walls of the first sub-notch, and the first segment and the third segment extend in the length direction of the air outlet frame.

In some embodiments of the present application, a first connection rib is provided between the mounting rib and the inner wall of the first notch.

In some embodiments of the present application, a plurality of first mounting members is spaced apart from each other in the length direction of the air outlet frame.

In some embodiments of the present application, the first and second mounting members have the same structure.

According to some embodiments of the present application, two ends of the air outlet frame in the length direction have a third mounting member and a fourth mounting member configured to mount the air outlet frame respectively, the third mounting member includes a second notch and a mounting batten located in the second notch, the second notch is located at an air inlet end of the air outlet frame, the mounting batten is provided in the second notch, two ends of the mounting batten in the length direction are connected with two opposite inner side walls of the second notch respectively, the rest part of the mounting batten is spaced apart from the inner wall of the second notch, and a rotation hole configured to accommodate a rotating shaft is formed at the mounting batten and has a mounting opening.

In some embodiments of the present application, a width of at least a portion of the rotation hole adjacent to the mounting hole is decreased gradually.

In some embodiments of the present application, in a direction toward the mounting opening, the width of the rotation hole is increased and then decreased gradually.

In some embodiments of the present application, a second connection rib is provided between the mounting batten and the inner wall of the second notch.

In some embodiments of the present application, the fourth mounting member is formed as a fitting hole.

The air conditioner according to embodiments of the present application includes: a housing, provided with an air outlet; the above-mentioned air outlet frame assembly, rotatably provided at the air outlet.

In the air conditioner according to embodiments of the present application, by providing the first limiting projection at the linkage member, providing the second limiting projection at the shift member, and separating the second and first limiting projections from the groove, after the deflector rod is mounted at the air guide bar, the part of the air guide bar may be limited between the second limiting projection and the bottom wall of the groove and between the first limiting projection and the bottom wall of the groove. Limited by the first and second limiting projections, the air guide bar may be prevented from moving out of the groove, thereby improving the connection strength and reliability between the deflector rod and the air outlet frame.

According to some embodiments of the present application, the two inner side walls of the air outlet in the width direction are provided with a third rotation member and a fourth rotation member, the third rotation member is located in the rotation hole, and the fourth rotation member is fitted with the fourth mounting member.

Additional aspects and advantages of embodiments of present application will be given in part in the following descriptions, become apparent in part from the following descriptions, or be learned from the practice of the present application.

BRIEF DESCRIPTION OF THE DRAWINGS

The above and/or additional aspects and advantages of the present application will become apparent and more readily appreciated from the following descriptions made with reference to the drawings, in which.

Figure 1:
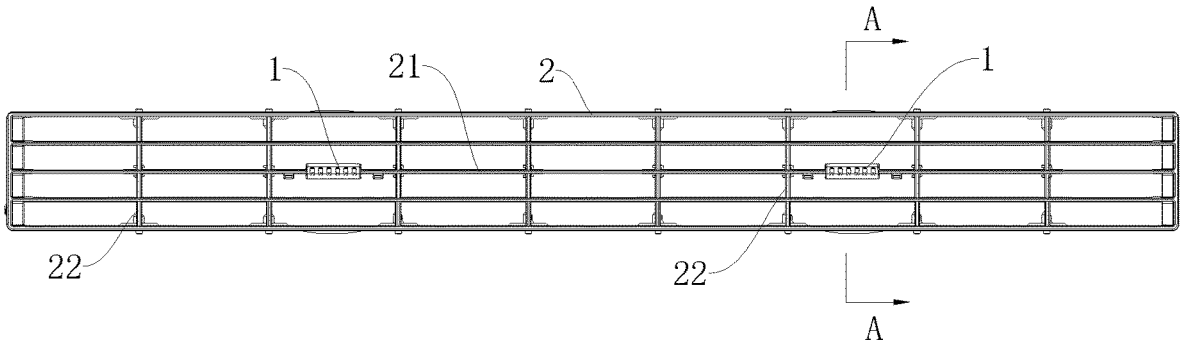
FIG. 1 is a front view of an air guide assembly consistent with embodiments of the present application.

REFERENCE NUMERALS air outlet frame assembly 100, deflector rod 1, linkage member 11, accommodation notch 111, first limiting projection 112, first guide slope 1121, recess 113, first receiving piece 114, first connection rib 115, first clasp groove 116, shift member 12, groove 121, second limiting projection 122, second guide slope 1221, shift rib 123, connection member 13, elastic member 14, air outlet frame 2, air guide bar 21, reinforcing rib plate 22, second receiving piece 23, second connection rib 24, second clasp groove 25, first mounting member 26, first notch 261, first sub-notch 2611, second sub-notch 2612 mounting rib 262, first segment 2621, second segment 2622, third segment 2623, mounting hole 2624, first connection rib 263, second mounting member 27, third mounting member 28, second notch 281, mounting batten 282, rotation hole 2821, second connection rib 283, fourth mounting member 29, louver 200, first rotation member 201, second rotation member 202

DETAILED DESCRIPTION

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present application. The embodiments shall not be construed to limit the present application.

A deflector rod 1 consistent with embodiments of the present application will be described below with reference to the accompanying drawings.

Figure 2:
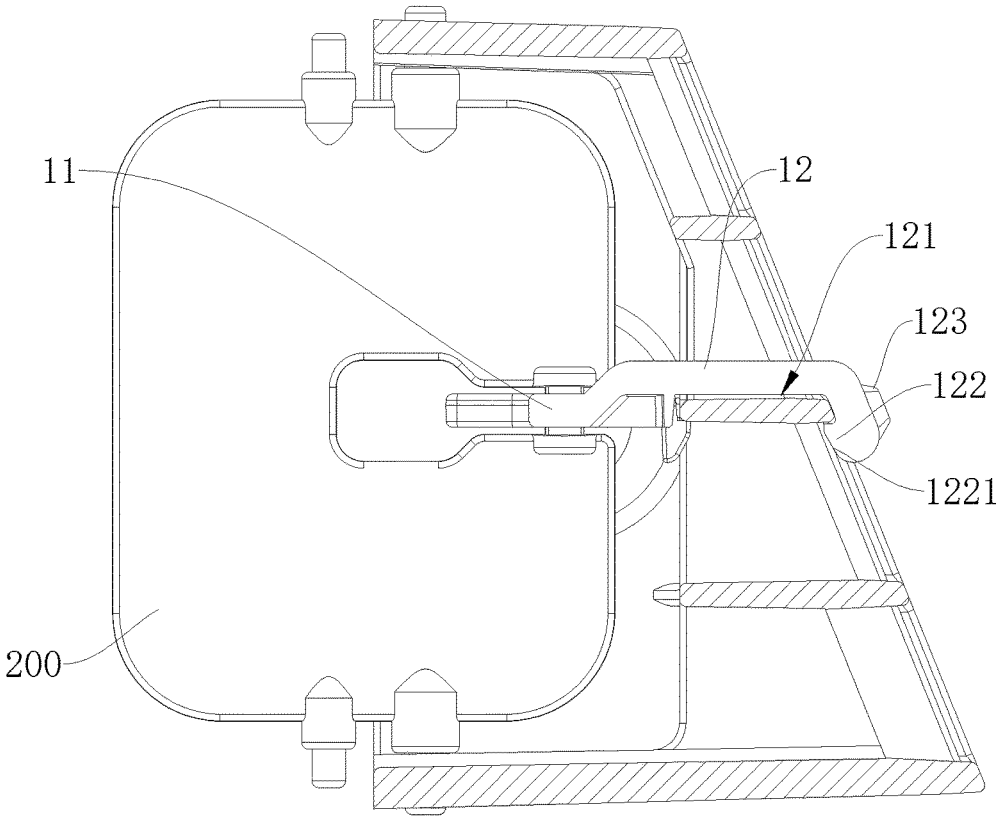
FIG. 2 is a cross-sectional view of the air guide assembly along line A-A in FIG. 1.

As shown in FIGS. 1 and 2, the deflector rod 1 according to embodiments of the present application is configured for an air outlet frame 2 having an air outlet channel with an air guide bar 21 extending in its length direction. The air outlet frame 2 is provided with a louver 200, and the deflector rod 1 includes a linkage member 11 configured to drive the louver 200 to rotate and a shift member 12.

Figure 5:
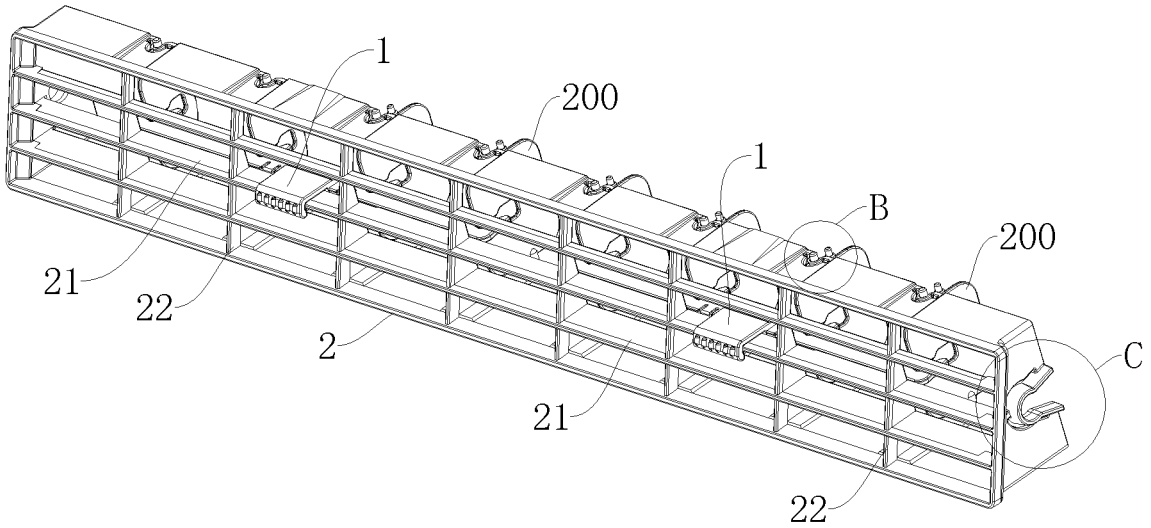
FIG. 5 is a perspective view of the air guide assembly consistent with embodiments of the present application.
Figure 11:
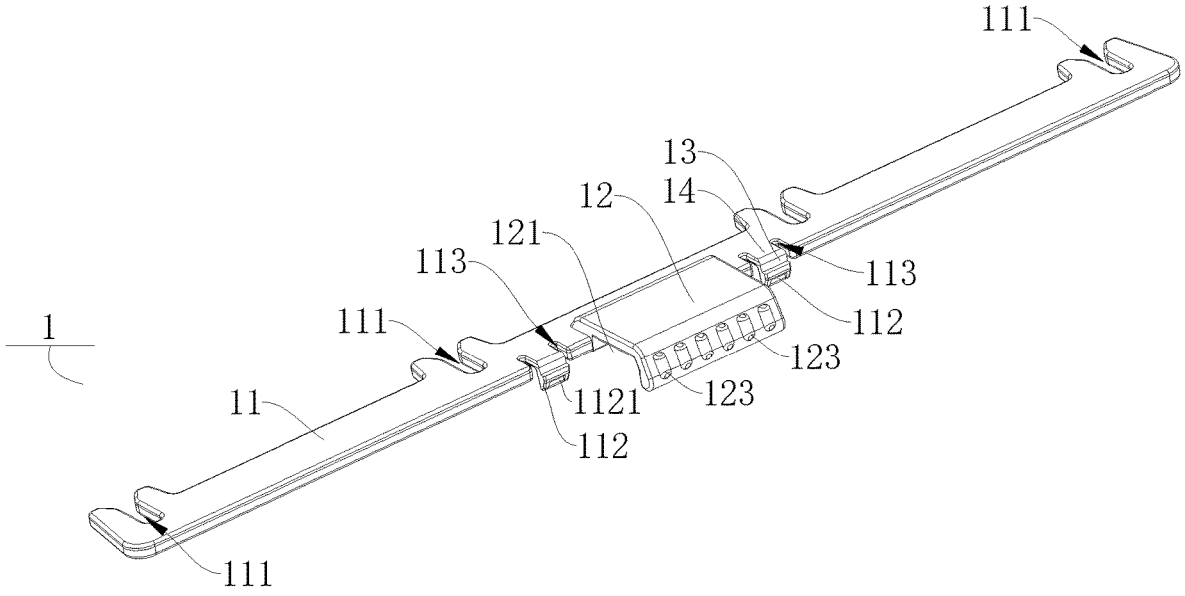
FIG. 11 is a perspective view of a deflector rod consistent with embodiments of the present application.

Specifically, as shown in FIGS. 2, 5 and 11, one end of the linkage member 11 is provided with a first limiting projection 112. The shift member 12 is connected to one end of the linkage member 11. The shift member 12 has a groove which extends to two opposite ends of the shift member 12. A second limiting projection 122 is provided at a side wall of the groove 121 apart from the linkage member 11. The second and first limiting projections 122 and 112 are both spaced apart from a bottom wall of the groove 121. The air guide bar 21 is at least partially located in the groove 121, between the second limiting projection 122 and the bottom wall of the groove 121, and between the first limiting projection 112 and the bottom wall of the groove 121. Specifically, in one example of the present application, the linkage member 11 is provided with the first limiting projection 112 at one end, and has an accommodation notch 111 at the other end.

It is understood that one end of the linkage member 11 proximal to the groove 121 is provided with the first limiting projection 112, while the side wall of the groove 121 apart from the linkage member 11 is provided with the second limiting projection 122. After the deflector rod 1 is mounted at the air guide bar 21, at least a portion of the air guide bar 21 is located in the groove 121. At this point, at least a portion of the air guide bar 21 may be limited between the second limiting projection 122 and the bottom wall of the groove 121 and between the first limiting projection 112 and the bottom wall of the groove 121 by the first and second limiting projections 112, 122 located at two sides of the groove 121. At this point, limited by the first and second limiting projections 112, 122, the air guide bar 21 may be prevented from moving out of the groove 121, thereby improving the connection strength and reliability between the deflector rod 1 and the air outlet frame 2.

In related art, the limiting projection is only provided at the side wall of the groove apart from the linkage member, and may only limit the connection of the deflector rod with the air guide bar at one side of the air guide bar in the width direction to some extent. The other side of the air guide bar in the width direction is not connected with the deflector rod, thus the deflector rod is not connected with the air guide bar reliably. In the present application, both sides of the air guide bar 21 in the width direction may be limited by the first and second limiting projections 112, 122 located at two sides of the groove 121, thereby improving the connection reliability of the deflector rod 1 and the air guide bar 21.

In some embodiments of the present application, two of at least one of the first or second limiting projection 112, 122 are provided. For example, two first limiting projections 112 and one second limiting projection 122 are provided; or one first limiting projection 112 and two second limiting projections 122 are provided; or two first limiting projections 112 and two second limiting projections 122 are provided. Therefore, a triangular or quadrangular structure may be formed, thereby further increasing the connection strength of the deflector rod 1 and the air deflector.

In the deflector rod 1 according to embodiments of the present application, by providing the first limiting projection 112 at the linkage member 11, providing the second limiting projection 122 at the shift member 12, and separating the second and first limiting projections 122 and 112 from the groove 121, after the deflector rod 1 is mounted at the air guide bar 21, the part of the air guide bar 21 may be limited between the second limiting projection 122 and the bottom wall of the groove 121 and between the first limiting projection 112 and the bottom wall of the groove 121. Limited by the first and second limiting projections 112, 122, the air guide bar 21 may be prevented from moving out of the groove 121, thereby improving the connection strength and reliability between the deflector rod 1 and the air outlet frame 2.

In the related art, an anti-interfere notch is provided at one end of the linkage member proximal to the shift member, thereby preventing the linkage member from interfering with the air outlet frame. In embodiments of the present application, the anti-interfere notch in the related art is omitted while it is ensured that the linkage member 11 does not interfere with the air outlet frame 2, thereby simplifying the structural complexity of the deflector rod 1, and facilitating the reduction in processing costs and production cycle of the deflector rod 1.

According to some embodiments of the present application, as shown in FIGS. 2 and 11, an end surface of the first limiting projection 112 apart from an inner side wall of the groove 121 has a first guide slope 1121 which is oblique in a direction from an opening to the bottom wall of the groove 121, apart from the linkage member 11. It is understood that when the shift member 12 is snapped on the air deflector, the first guide slope 1121 guides the mounting of the shift member 12. Under the guide of the first guide slope 1121, the difficulty in mounting the shift member 12 may be reduced, thereby improving the mounting smoothness of the shift member 12. In addition, abnormal wear is also avoided between the first limiting projection 112 and the air deflector during the process of snapping the shift member 12, thereby prolonging the service life of the air deflector and the deflector rod 1.

Figure 13:
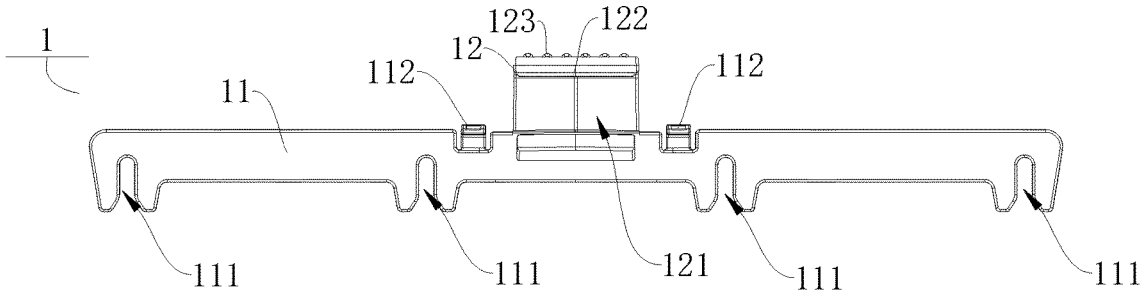
FIG. 13 is a bottom view of the deflector rod consistent with embodiments of the present application.

According to some embodiments of the present application, as shown in FIGS. 11 and 13, the deflector rod 1 further includes a connection member 13, having one end connected with one end of the linkage member 11 proximal to the shift member 12, and the other end connected with the first limiting projection 112, the other end of the connection member 13 extending towards a side apart from the bottom wall of the groove 121. It is understood that when the shift member 12 is snapped at the air deflector, the first limiting projection 112 will be deviated to some extent. By providing the connection member 13, the first limiting projection 112 is connected with one end of the connection member 13, such that the first limiting projection 112 has a reduced stress in the case of position offset, thereby lowering the difficulty in offset of the first limiting projection 112, and preventing the first limiting projection 112 from being broken from the linkage member 11, thereby improving the mounting reliability of the deflector rod 1.

Figure 12:
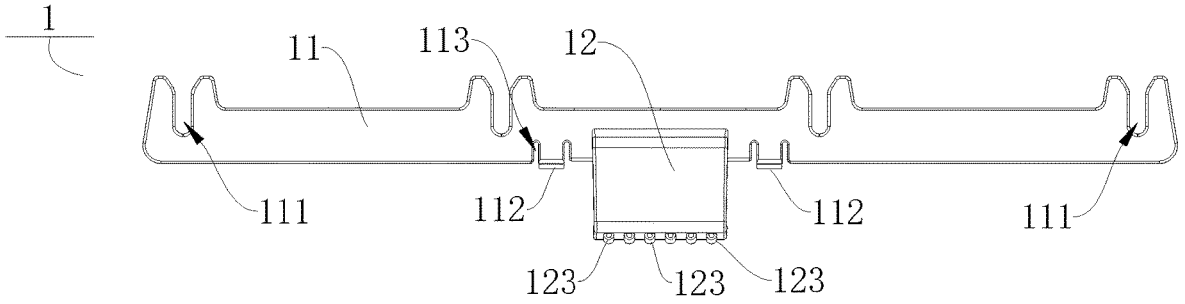
FIG. 12 is a top view of the deflector rod consistent with embodiments of the present application.

In some embodiments of the present application, as shown in FIGS. 11 and 12, one end of the linkage member 11 proximal to the shift member 12 has a recess 113, the deflector rod 1 further includes an elastic member 14, having one end in a length direction connected with a bottom wall of the recess 113, the other end in the length direction connected with the connection member 13, and both sides in a width direction spaced apart from an inner peripheral wall of the recess 113.

It is understood that a sufficient amount of elastic deformation exists between the elastic member 14 and the recess 113. When the shift member 12 is snapped at the air deflector, the difficulty in mounting the shift member 12 may be further lowered using the position offset of the elastic member 14 and the connection member 13, thereby further avoiding the reduction in reliability of connection between the first limiting projection 112 and the linkage member 11, and improving the structural reliability of the deflector rod 1 and prolonging the service life of the deflector rod 1.

In an example of the present application, the connection member 13, the elastic member 14 and the linkage member 11 are integrally molded. Therefore, the integral structure may not only ensure the structure and performance stabilities of the connection member 13, the elastic member 14 and the linkage member 11, but also facilitate the molding and manufacturing, and dispense with unnecessary assembly parts and connection processes, greatly improving an assembly efficiency of the connection member 13, the elastic member 14 and the linkage member 11 and ensuring the connection reliability of the connection member 13, the elastic member 14 and the linkage member 11. Further, the integral structure has a high overall strength and stability, is more convenient to assemble and has a longer service life.

According to some embodiments of the present application, as shown in FIGS. 2 and 13, an end surface of the second limiting projection 122 distal from an inner side wall of the groove 121 has a second guide slope 1221 which is oblique in a direction from an opening to the bottom wall of the groove 121, close to the linkage member 11. It is understood that when the shift member 12 is snapped on the air deflector, the second guide slope 1221 guides the mounting of the shift member 12. Under the guide of the second guide slope 1221, the difficulty in mounting the shift member 12 may be reduced, thereby improving the mounting smoothness of the shift member 12. In addition, abnormal wear is also avoided between the second limiting projection 122 and the air deflector during the process of snapping the shift member 12, thereby prolonging the service life of the air deflector and the deflector rod 1.

In some embodiments of the present application, as shown in FIG. 2, a maximum height H of the second limiting projection 122 ranges from 0.5 mm to 1.5 mm. Compared with the related art, the maximum height of the second limiting projection 122 is reduced, and during the process of snapping the shift member 12, a displacement required for the second limiting projection 122 is reduced, thereby reducing the difficulty in mounting the deflector rod 1 and facilitating improvement of the mounting efficiency of the deflector rod 1. For example, in some examples of the present application, the maximum height of the second limiting projection 122 is 0.5 mm, 0.6 mm, 0.7 mm, 0.8 mm, 0.9 mm, 1.0 mm, 1.1 mm, 1.2 mm, 1.3 mm, 1.4 mm or 1.5 mm. Specifically, the maximum height of the second limiting projection 122 may be designed according to the model, size, and application environment of the deflector rod 1.

It should be noted that the height refers to a projected length of a portion of the second limiting projection 122 extending into the groove 121 on a plane where the bottom wall of the groove 121 is located.

According to some embodiments of the present application, as shown in FIGS. 11 and 12, a plurality of shift ribs 123 are provided spaced apart from each other at an outer side wall of the shift member 12 apart from the linkage member 11. By providing the plurality of shift ribs 123 which are spaced apart from each other, a frictional force between a user and the shift member 12 may be increased, such that slippage is avoided when the user pushes the shift member 12 to slide left and right, thereby reducing the difficulty in adjustment by the user and improving the use convenience.

In some embodiments of the present application, as shown in FIGS. 11 and 12, the plurality of the shift ribs 123 are spaced apart from each other in a length direction of the air guide bar 21, and each of the shift ribs 123 extends in a direction perpendicular to the length direction of the air guide bar 21. Thus, a contact area between the finger and the shift rib 123 may be increased, thereby further reducing the difficulty in adjustment by the user and improving the use convenience.

In some embodiments of the present application, the plurality of shift ribs 123 which are spaced apart from each other and the shift member 12 are integrally molded. Therefore, the integral structure may not only ensure the structural stability and performance stability of the shift rib 123 and the shift member 12, but also facilitate the molding and manufacturing, and dispense with unnecessary assembly parts and connection processes, greatly improving an assembly efficiency of the shift rib 123 and the shift member 12 and ensuring the connection reliability of the shift rib 123 and the shift member 12. Further, the integral structure has a high overall strength and stability, is more convenient to assemble and has a longer service life.

Figure 3:
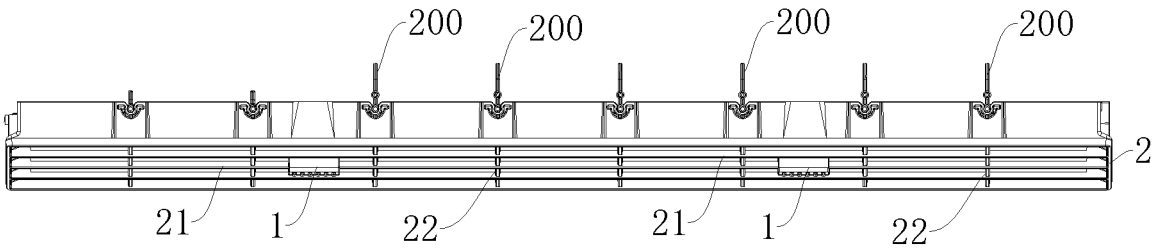
FIG. 3 is a top view of the air guide assembly consistent with embodiments of the present application.
Figure 4:
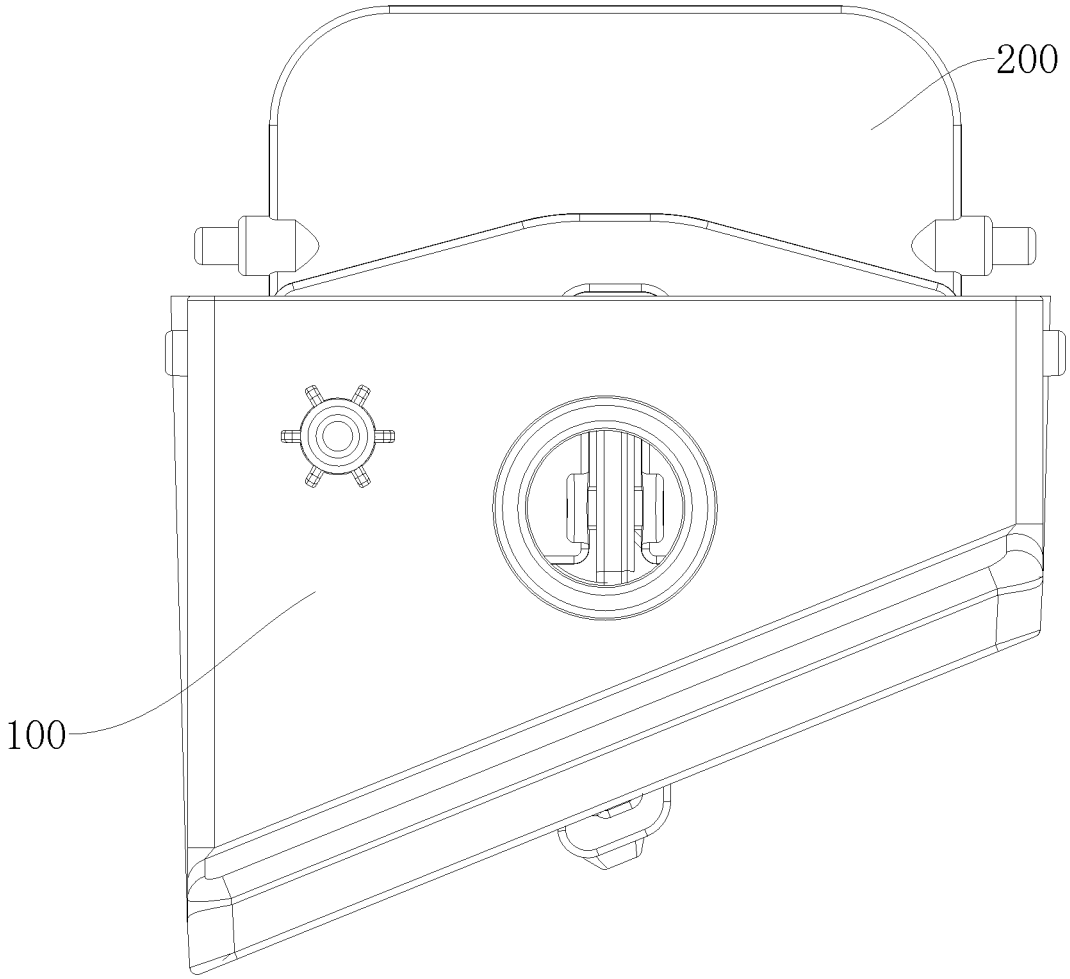
FIG. 4 is a left view of the air guide assembly consistent with embodiments of the present application.
Figure 8:
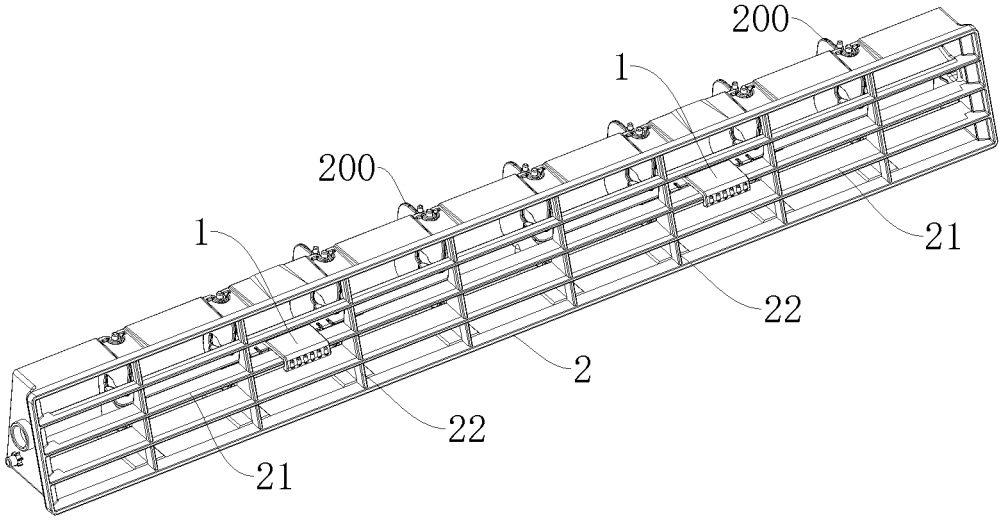
FIG. 8 is a perspective view of the air guide assembly consistent with embodiments of the present application from another direction.

According to some embodiments of the present application, as shown in FIGS. 3, 8, and 11, the linkage member 11 extends in a length direction of the air guide bar 21, the linkage member 11 is provided with a plurality of accommodation notches 111, and the plurality of accommodation notches 111 are space apart in the length direction of the linkage member 11. Thus, the rotation direction of the plurality of louvers 200 may be adjusted by using one linkage member 11, and it is no longer necessary to provide a plurality of deflector rods 1, thereby simplifying the complexity of the structure and lowering the mounting difficulty.

In one example of the present application, an escape notch is provided between two adjacent accommodation notches 111 at one end of the linkage member 11 distal from the shift member 12. In the process of sliding the linkage member 11 to the left, the escape notch may prevent the linkage member 11 from interfering with other components of the air outlet frame 2, thereby improving the smoothness and reliability of the linkage member 11 sliding left and right.

In some embodiments of the present application, the linkage member 11 and the shift member 12 are integrally molded. Therefore, the integral structure may not only ensure the structural stability and performance stability of the linkage member 11 and the shift member 12, but also facilitate the molding and manufacturing, and dispense with unnecessary assembly parts and connection processes, greatly improving an assembly efficiency of the linkage member 11 and the shift member 12 and ensuring the connection reliability of the linkage member 11 and the shift member 12. Further, the integral structure has a high overall strength and stability, is more convenient to assemble and has a longer service life.

The air outlet frame assembly 100 consistent with embodiments of the present application will be described below with reference to the accompanying drawings.

Figure 9:
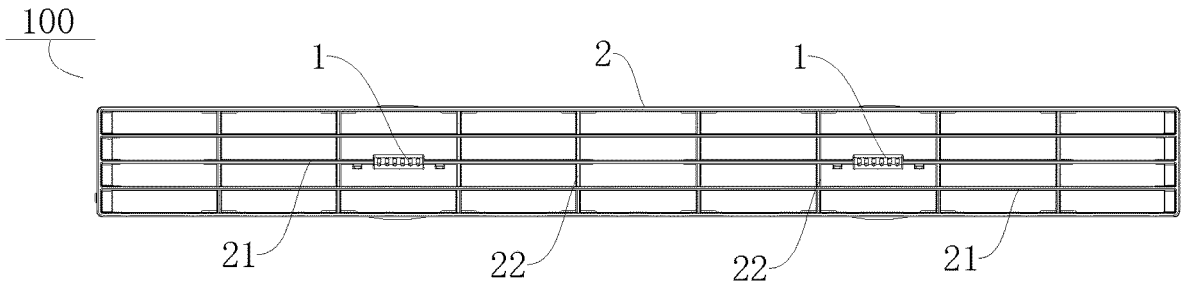
FIG. 9 is a front view of an air outlet frame assembly consistent with embodiments of the present application.

As shown in FIGS. 2 and 9, the air outlet frame assembly 100 consistent with embodiments of the present application includes: the air outlet frame 2, the deflector rod 1 and the louver 200. The air outlet frame 2 has the air outlet channel with the air guide bar 21 extending in a length direction thereof, the air guide bar 21 is at least partially located in the groove 121, between the first limiting projection 112 and the bottom wall of the groove 121 and between the second limiting projection 122 and the bottom wall of the groove 121, and the louver 200 is rotatably provided at the air outlet frame 2, located upstream of the air guide bar 21 in an air flow direction, and has one end proximal to the air guide bar 21 connected with the other end of the linkage member 11.

Figure 14:
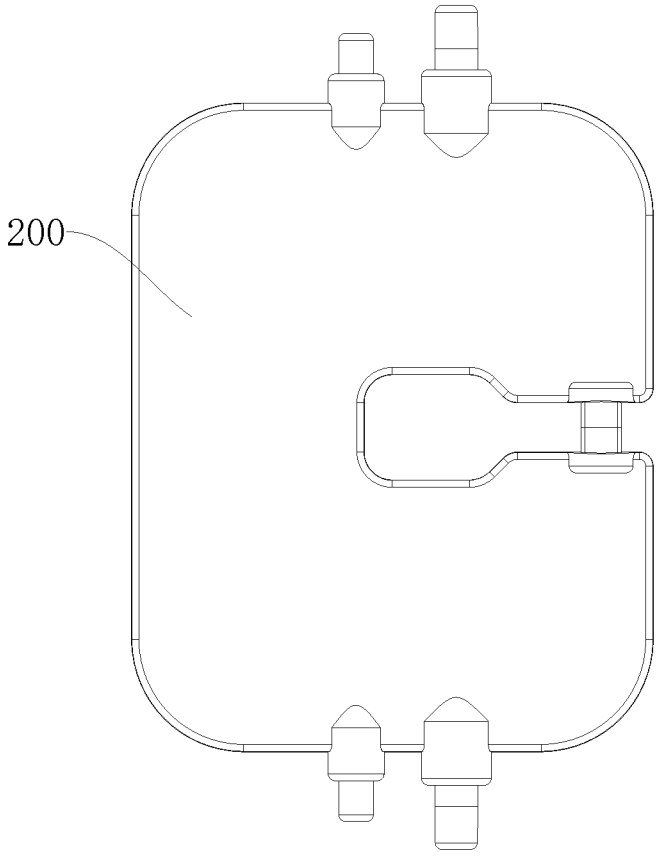
FIG. 14 is a schematic structural diagram of a louver of the air guide assembly consistent with embodiments of the present application.

Specifically, in some embodiments of the present application, a plurality of deflector rods 1 are provided spaced apart from each other in the length direction of the air outlet frame 2. Thus, the deflection angle of the louvers 200 at different positions (referring to FIG. 14) may be adjusted by the deflector rods at different positions, thereby implementing multi-zone air supply from one air outlet channel, and further better meeting different requirements from users at different positions. For example, in one example of the present application, two deflector rods 1 are provided and slidably fixed to the same one air guide bar 21, and the two deflector rods 1 are spaced apart from each other in the length direction of the air guide bar 21.

In one example of the present application, the deflector rod 1 is movably provided at the air guide bar 21 of the air outlet frame 2 left and right, and by connecting one end of the louver 200 proximal to the air guide bar 21 with the other end of the linkage member 11, the deflector rod 1 may drive the louver 200 to rotate when moving left and right, thereby adjusting the deflection direction of the louver 200.

Figure 6:
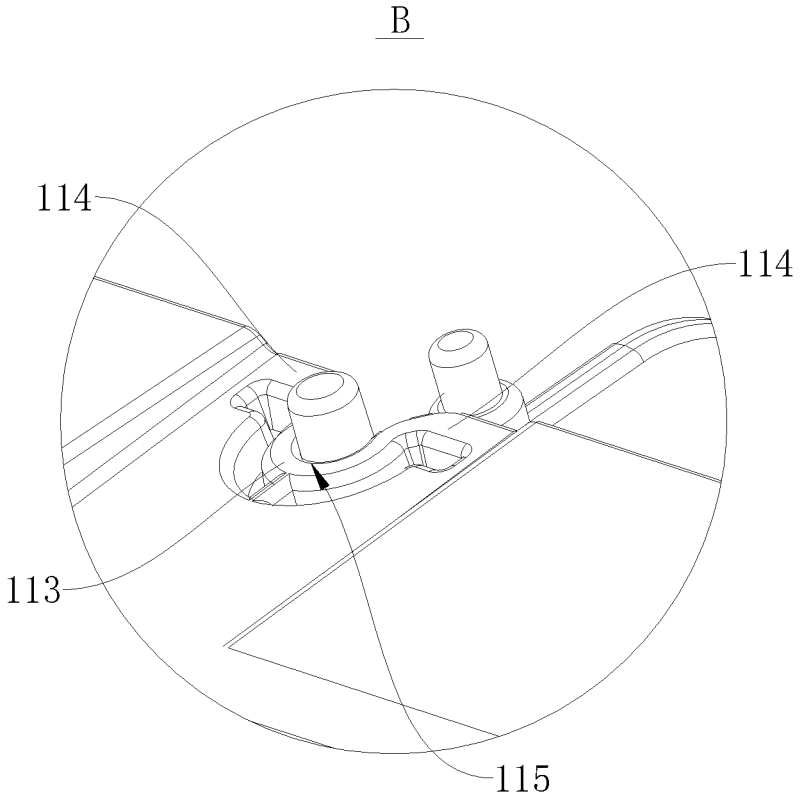
FIG. 6 is an enlarged view of part B in FIG. 5.

For example, in the embodiment shown in FIGS. 2 and 11, the louver 200 is located upstream of the air guide bar 21 in the air flow direction, and one end of the louver 200 proximal to the air guide bar 21 is snapped in the accommodation notch 11. Specifically, as shown in FIGS. 6 and 10, in one example of the present application, a pivot notch is provided at each of the upper and lower wall surfaces of the air outlet frame 2, a first receiving piece 114 is provided in the pivot notch, a gap exists between at least one part of the first receiving piece 114 and an edge of the pivot notch, the first receiving piece 114 is connected with an inner peripheral edge of the pivot notch with a first connection rib 115, a first clasp groove 116 with a small opening and a large internal space is formed in the first receiving piece 114, and the louver 200 is mounted to the deflector rod 1 by means of the first receiving piece 114.

In the air outlet frame assembly 100 consistent with embodiments of the present application, by providing the first limiting projection 112 at the linkage member 11, providing the second limiting projection 122 at the shift member 12, and separating the second and first limiting projections 122, 112 from the bottom wall of the groove 121, after the deflector rod 1 is mounted at the air guide bar 21, the part of the air guide bar 21 may be limited between the second limiting projection 122 and the bottom wall of the groove 121 and between the first limiting projection 112 and the bottom wall of the groove 121. Limited by the first and second limiting projections 112, 122, the air guide bar 21 may be prevented from moving out of the groove 121, thereby improving the connection strength and reliability between the deflector rod 1 and the air outlet frame 2.

Figure 10:
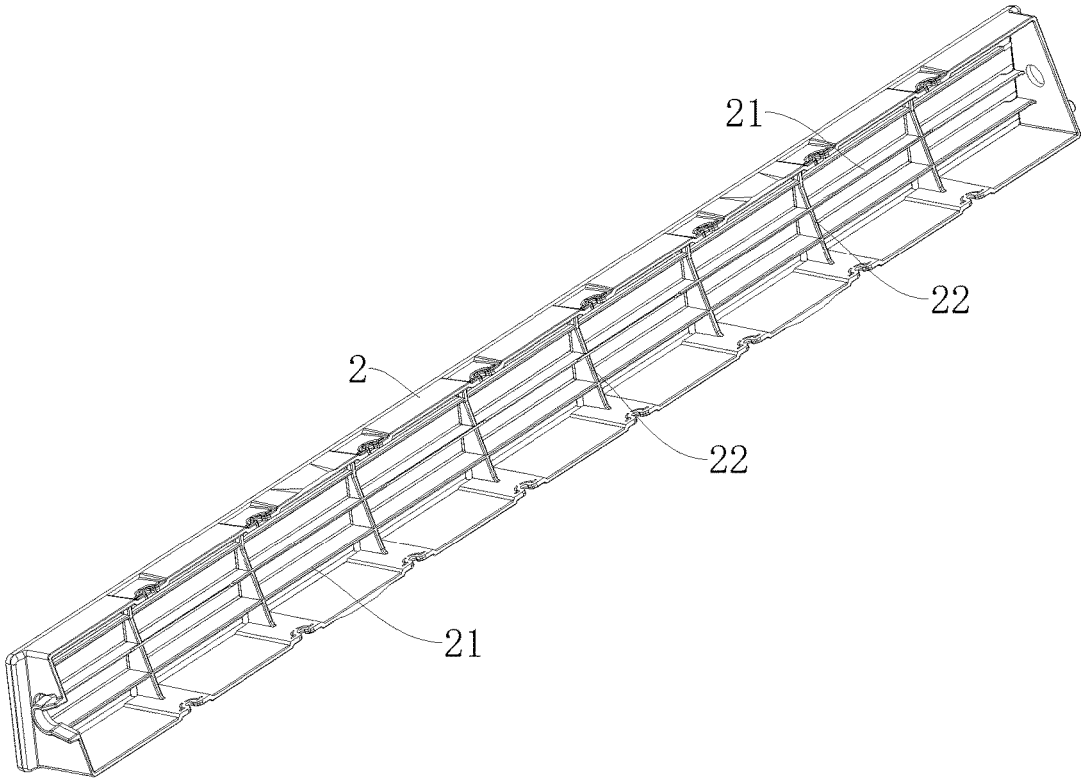
FIG. 10 is a perspective view of an air outlet frame consistent with embodiments of the present application.

According to some embodiments of the present application, as shown in FIGS. 8 and 10, the air outlet channel is further provided therein with a plurality of reinforcing rib plates 22 which extend in a width direction of the air outlet channel and is spaced apart from each other in a length direction of the air outlet channel, and the air guide bar 21 is connected with the plurality of the reinforcing rib plates 22. It is understood that by providing the reinforcing rib plate 22, the structural strength of the air outlet frame 2 may be increased, and the structural reliability of the air outlet frame 2 may be improved. Moreover, the reinforcing rib plate 22 guides the air flow in the air outlet channel, and under the guide of the reinforcing rib plate 22, a rotational flow is avoided in the flow process of air flow, thereby improving the smoothness of air flow. Specifically, in one example of the present application, in the air flow direction, the wall surface at the inner side of the reinforcing rib plate 22 is flush with the wall surface at the inner side of the air deflector.

In the related art, in the air flow direction, an escape opening is provided at a joint between the wall surface at the inner side of the reinforcing rib plate and the wall surface at the inner side of the air deflector. In the present application, the wall surface at the inner side of the reinforcing rib plate 22 is flush with the wall surface at the inner side of the air deflector, thereby simplifying the structure of the air outlet frame 2 and facilitating the reduction in processing costs and production cycle of the air outlet frame 2.

According to some embodiments of the present application, as shown in FIGS. 8 and 9, a plurality of air guide bars 21 are provided, and are spaced apart from each other in the width direction of the air outlet channel. It is understood that the air guide bar 21 guides the air flow in the air outlet channel, and a rotational flow is avoided in the flow process of air flow under the guide of the air guide bar 21, thereby improving the smoothness of the air flow.

An air conditioner consistent with embodiments of the present application will be described below with reference to the drawings.

The air conditioner consistent with embodiments of the present application includes the above-mentioned air outlet frame assembly 100.

Figure 7:
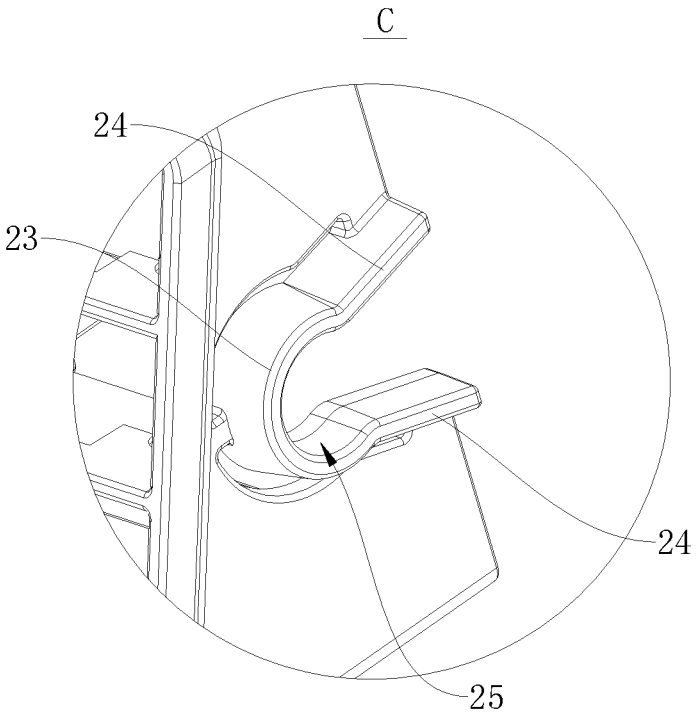
FIG. 7 is an enlarged view of part C in FIG. 5.

For example, as shown in FIGS. 7 and 10, in an example of the present application, one end of the air outlet frame 2 is inserted into a surface frame, and the other end of the air outlet frame 2 is engaged with the surface frame. Specifically, the end of the air outlet frame 2 that is engaged with the surface frame has a snap joint structure which includes a main body portion and a second receiving piece 23. The main body portion is provided with an engagement notch, the second receiving piece 23 is provided in the engagement notch, a gap exists between at least a portion of the second receiving piece 23 and the edge of the engagement notch, the second receiving piece 23 is connected with the inner peripheral edge of the engagement notch by a second connection rib 24, a second clasp groove 25 with a small opening and a large internal space is formed in the second receiving piece 23, and the air outlet frame 2 is mounted on the surface frame by means of the snap joint structure.

In the air conditioner consistent with embodiments of the present application, by providing the first limiting projection 112 at the linkage member 11, providing the second limiting projection 122 at the shift member 12, and separating the second and first limiting projections 122, 112 from the bottom wall of the groove 121, after the deflector rod 1 is mounted at the air guide bar 21, the part of the air guide bar 21 may be limited between the second limiting projection 122 and the bottom wall of the groove 121 and between the first limiting projection 112 and the bottom wall of the groove 121. Limited by the first and second limiting projections 112, 122, the air guide bar 21 may be prevented from moving out of the groove 121, thereby improving the connection strength and reliability between the deflector rod 1 and the air outlet frame 2.

An air outlet frame 2 consistent with embodiments of the present application will be described below with reference to the drawings.

Figure 15:
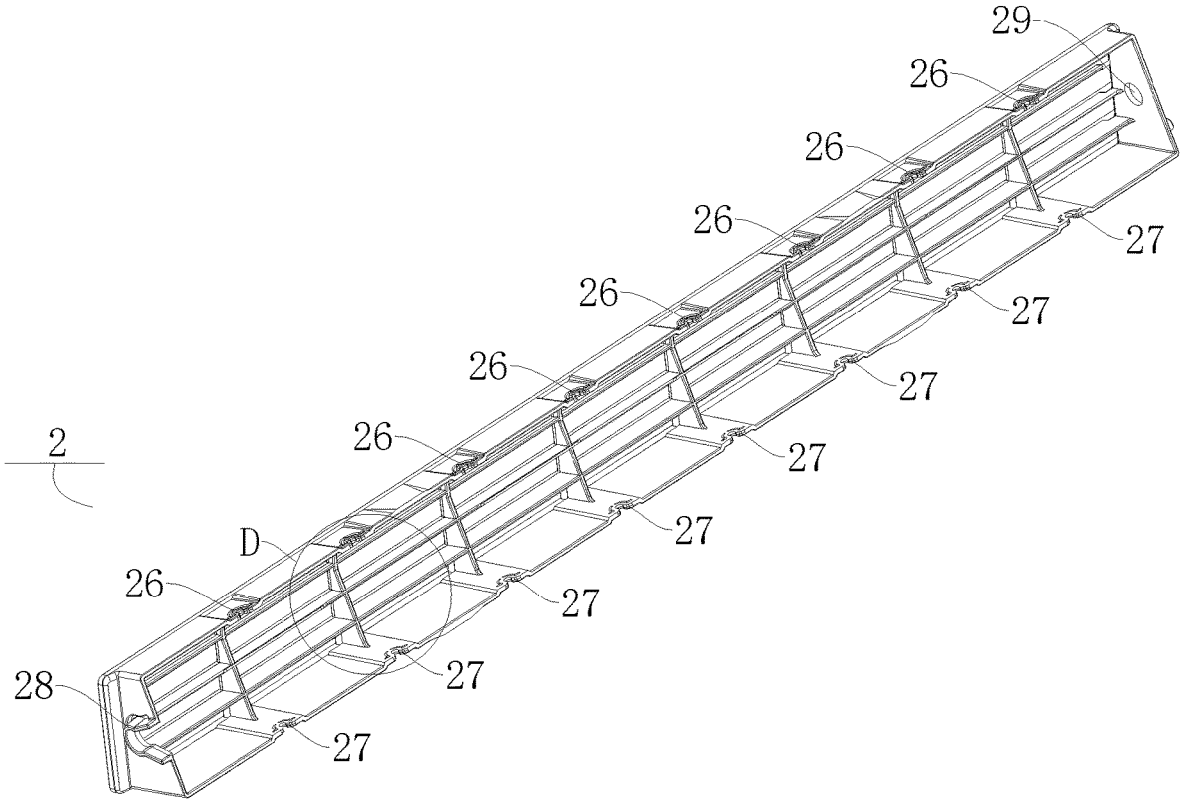
FIG. 15 is a perspective view of another air outlet frame consistent with embodiments of the present application.
Figure 16:
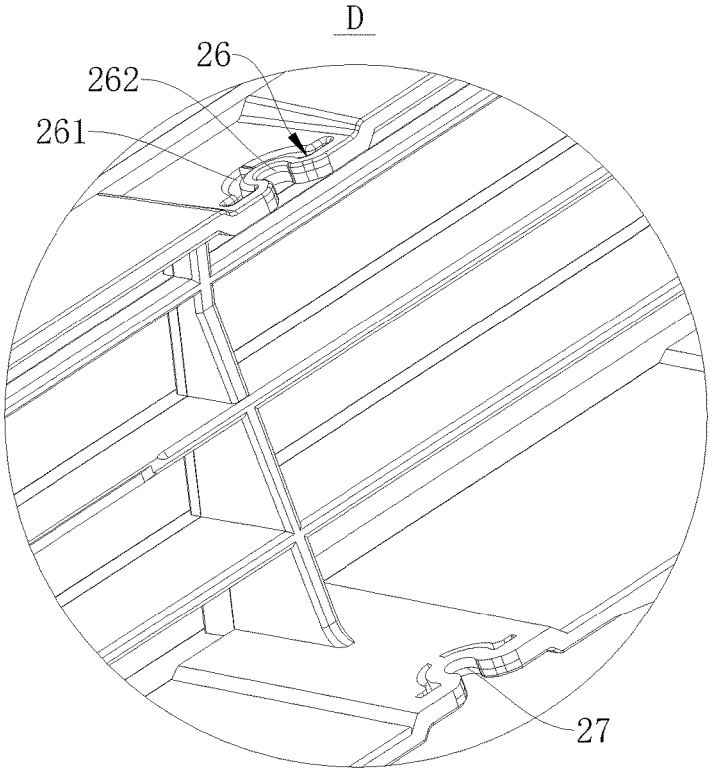
FIG. 16 is an enlarged view of part Din FIG. 15.
Figure 26:
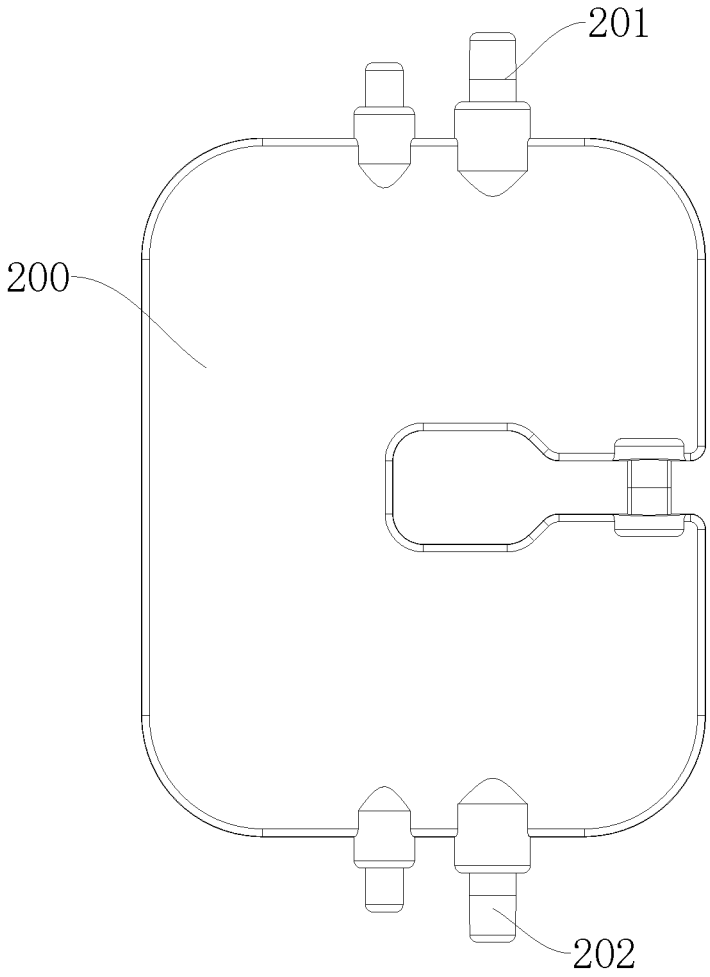
FIG. 26 is a schematic structural diagram of a louver of the other air outlet frame assembly consistent with embodiments of the present application.

As shown in FIGS. 15 and 16, in the air outlet frame 2 consistent with embodiments of the present application, a first mounting member 26 and a second mounting member 27 for mounting the louver 200 (referring to FIG. 26) are provided at two ends of the air outlet frame 2 respectively. The first and second mounting members 26 and 27 may be configured to limit the position of the louver 200.

Figure 17:
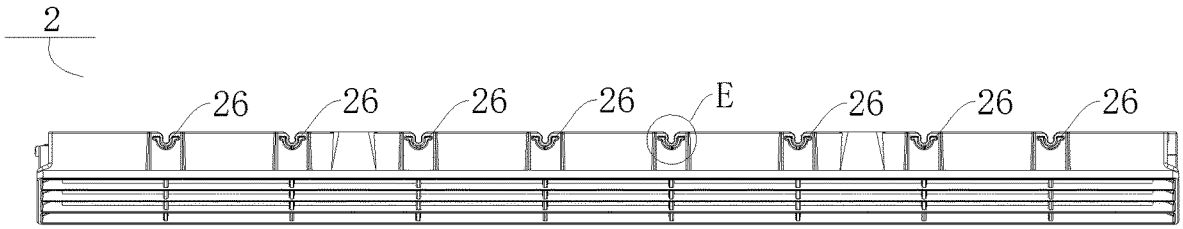
FIG. 17 is a top view of the other air outlet frame consistent with embodiments of the present application.
Figure 18:
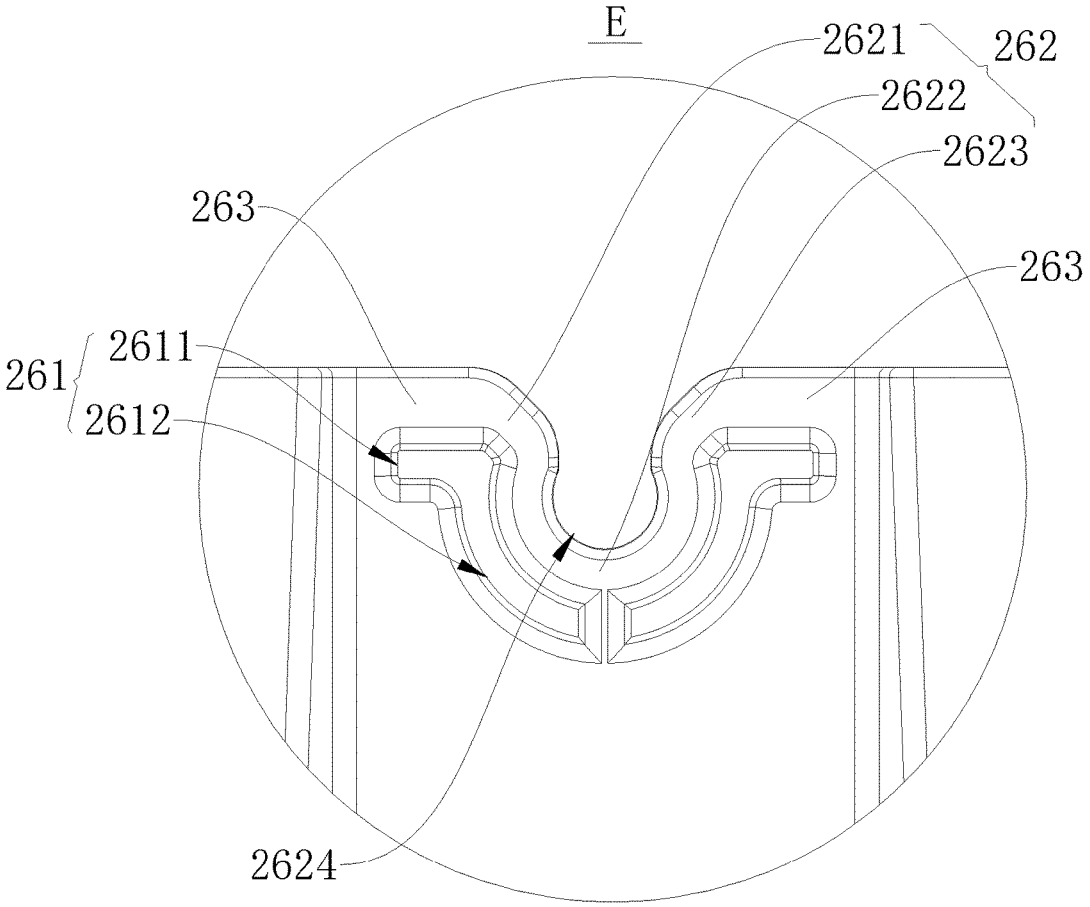
FIG. 18 is an enlarged view of part E in FIG. 17.

Specifically, as shown in FIGS. 17 and 18, the first mounting member 26 includes a first notch 261 and a mounting rib 262 located in the first notch 261, wherein the first notch 261 is located at an air inlet end of the air outlet frame 2, the mounting rib 262 is provided in the first notch 261, two ends of the mounting rib 262 in the length direction are connected with two opposite inner side walls of the first notch 261, the rest part of the mounting rib 262 is spaced apart from the inner wall of the first notch 261, and a mounting hole 2624 configured to mount the louver 200 is formed at the mounting rib 262, and has a mounting notch.

It is understood that only the two ends of the mounting rib 262 in the length direction are fixed at the two opposite inner side walls of the first notch 261, the rest part of the mounting rib 262 is spaced apart from the inner wall of the first notch 261, and a space with good elastic deformation is formed between a part of the mounting ribs 262 which are spaced apart from each other and the first notch 261. Thus, an acting force between the mounting rib 262 and the air outlet frame 2 may be reduced, thereby reducing a resistance during the mounting of the louver 200.

Specifically, when the louver 200 is mounted, pressed by the louver 200, the part of the mounting rib 262 spaced apart from the inner wall of the first notch 261 may tend to displace and deform easily, and at this point, the louver 200 may be snapped in the mounting hole 2624 with ease. Thus, the difficulty in mounting the louver 200 may be reduced, thereby improving the assembly efficiency of the louver 200.

In some embodiments of the present application, as shown in FIGS. 15 and 16, the first and second mounting members 26 and 27 have the same structure. In other words, the second mounting member 27 includes a first notch 261 and a mounting rib 262 located in the first notch 261, wherein the first notch 261 is located at an air inlet end of the air outlet frame 2, the mounting rib 262 is provided in the first notch 261, two ends of the mounting rib 262 in the length direction are connected with two opposite inner side walls of the first notch 261, the rest part of the mounting rib 262 is spaced apart from the inner wall of the first notch 261, and a mounting hole 2624 configured to mount the louver 200 is formed at the mounting rib 262, and has a mounting notch.

The same structure of the first and second mounting members 26 and 27 may not only reduce the difficulty in designing and manufacturing the first and second mounting members 26 and 27, but also enhance structural symmetry and aesthetics. Further, when the louver 200 is mounted, the louver 200 and the first and second mounting members 26 and 27 are subjected to the same force, thereby improving the force uniformity in two ends during the process of mounting the louver 200, and further increasing the mounting efficiency of the louver 200.

In the air outlet frame 2 consistent with embodiments of the present application, by providing the mounting rib 262 in the first notch 261 of the air outlet frame 2, forming a mounting hole 2624 configured to mount the louver 200 at the mounting rib 262, connecting two ends of the mounting rib 262 in the length direction with two opposite inner side walls of the first notch 261, and spacing the rest part of the mounting rib 262 apart from the inner wall of the first notch 261, the elasticity of the mounting rib 262 may be improved; when the louver 200 is mounted, pressed by the louver 200, the part of the mounting rib 262 spaced apart from the inner wall of the first notch 261 may tend to displace and deform easily, and at this point, the louver 200 may be snapped in the mounting hole 2624 with ease. Thus, the difficulty in mounting the louver 200 may be reduced, thereby improving the mounting efficiency of the louver 200.

Figure 23:
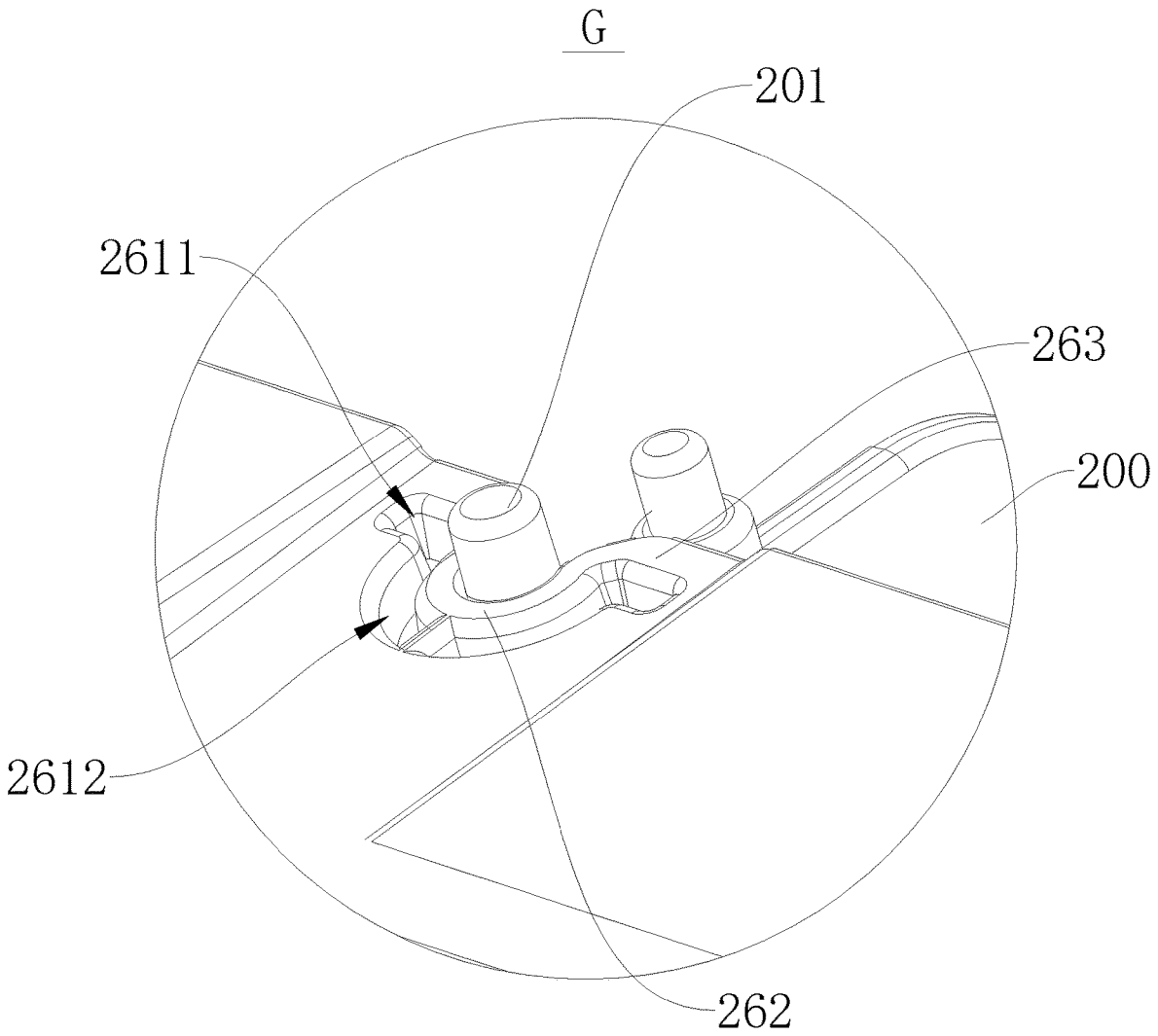
FIG. 23 is an enlarged view of part G in FIG. 22.

According to some embodiments of the present application, as shown in FIGS. 18 and 23, a width of at least a portion of the mounting hole 2624 adjacent to the mounting notch is decreased gradually. It is understood that the width of the mounting notch of the mounting hole 2624 is relatively small. When the louver 200 is mounted into the mounting hole 2624, the mounting notch with a relatively small width may limit the position of the louver 200, so as to prevent the louver 200 from moving out of the mounting hole 2624, thereby guaranteeing the mounting reliability of the louver 200. For example, in some examples of the present application, in a direction from the bottom wall to the mounting notch of the mounting hole 2624, the width of at least a portion of the mounting hole 2624 adjacent to the mounting notch is decreased gradually.

In some embodiments of the present application, as shown in FIGS. 18 and 23, in a direction toward the mounting notch, the width of the mounting hole 2624 is increased and then decreased gradually. In the direction toward the mounting notch, the inner wall surface of the portion of the mounting hole 2624 with a gradually increasing width may be better fitted with the corresponding fixing part of the louver 200. When the louver 200 is mounted in place, the mounting hole 2624 may better limit and position the louver 200.

According to some embodiments of the present application, as shown in FIGS. 18 and 23, the first notch 261 includes a first sub-notch 2611 formed at the air inlet end of the air inlet frame 2 and a second sub-notch 2612 formed at a bottom wall of the first sub-notch 2611, a maximum width of the second sub-notch 2612 is less than a minimum width of the first sub-notch 2611, the mounting rib 262 includes a first segment 2621, a second segment 2622 and a third segment 2623 which are connected successively, the second segment 2622 is opposite to the second sub-notch 2612, the mounting hole 2624 is formed at the second segment 2622, one end of the first segment 2621 and one end of the third segment 2623 are connected with two ends of the second segment 2622 in the length direction respectively, the other end of the first segment 2621 and the other end of the third segment 2623 are connected with two opposite inner side walls of the first sub-notch 2611, and the first segment 2621 and the third segment 2623 extend in the length direction of the air outlet frame 2.

It is understood that by providing the first and second sub-notches 2611 and 2612, and making the maximum width of the second sub-notch 2612 less than the minimum width of the first sub-notch 2611, an overlarge spacing between the mounting rib 262 and the second sub-notch 2612 may be avoided, thereby guaranteeing the connection strength of the mounting rib 262 and the first notch 261, and further the connection and limitation reliability of the mounting rib 262 and the louver 200.

In addition, the mounting rib 262 includes a first segment 2621, a second segment 2622 and a third segment 2623 which are connected successively, thereby reducing the structural complexity of the mounting rib 262, decreasing the difficulty in manufacturing the mounting rib 262, improving the production efficiency of the mounting rib 262, and lowering the production cost of the mounting rib 262.

Specifically, in an example of the present application, the first, second and third segments 2621, 2622 and 2623 are integrally molded. Therefore, the integral structure may not only ensure the structural stability and performance stability of the first, second and third segments 2621, 2622 and 2623, but also facilitate the molding and manufacturing, and dispense with unnecessary assembly parts and connection processes, greatly improving an assembly efficiency of the first, second and third segments 2621, 2622 and 2623 and ensuring the connection reliability of the first, second and third segments 2621, 2622 and 2623. Further, the integral structure has a high overall strength and stability, is more convenient to assemble and has a longer service life.

According to some embodiments of the present application, as shown in FIGS. 18 and 23, a first connection rib 263 is provided between the mounting rib 262 and the inner wall of the first notch 261. It is understood that one end of the first connection rib 263 is connected with the mounting rib 262, and the other end of the first connection rib 263 is connected with the inner wall of the first notch 261. The first connection rib 263 may simplify the connection structure between the mounting rib 262 and the first notch 261, facilitating the reduction in costs. Specifically, in one example of the present application, two first connection ribs 263 are provided, wherein one end of one of the first connection ribs 263 is connected with one end of the mounting rib 262 in the length direction, and the other end of one of the first connection ribs 263 is connected with the inner wall of one side of the first notch 261; one end of the other of the first connection ribs 263 is connected with the other end of the mounting rib 262 in the length direction, and the other end of the other of the first connection ribs 263 is connected with the inner wall of the other side of the first notch 261.

In some embodiments of the present application, the first connection rib 263 and the mounting rib 262 are integrally molded. Therefore, the integral structure may not only ensure the structural stability and performance stability of the first connection rib 263 and the mounting rib 262, but also facilitate the molding and manufacturing, and dispense with unnecessary assembly parts and connection processes, greatly improving an assembly efficiency of the first connection rib 263 and the mounting rib 262 and ensuring the connection reliability of the first connection rib 263 and the mounting rib 262. Further, the integral structure has a high overall strength and stability, is more convenient to assemble and has a longer service life.

Figure 22:
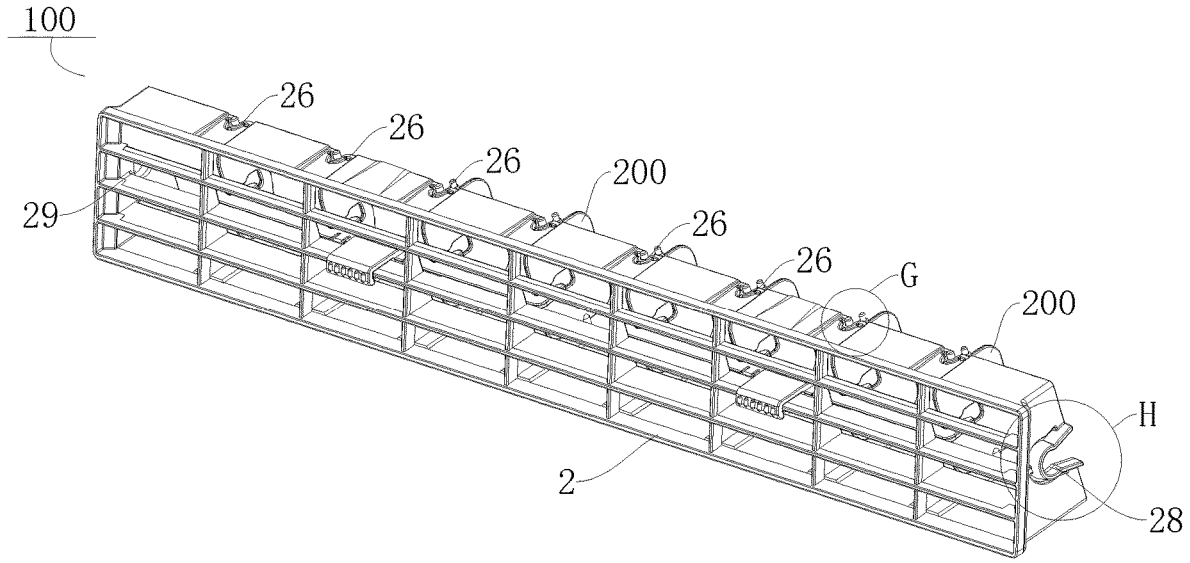
FIG. 22 is a perspective view of the other air outlet frame assembly consistent with embodiments of the present application.

According to some embodiments of the present application, as shown in FIGS. 17 and 22, a plurality of first mounting members 26 is spaced apart from each other in the length direction of the air outlet frame 2. For example, in an example of the present application, as shown in FIGS. 1 and 3, a plurality of first mounting members 26 is spaced apart from each other in the length direction of the air outlet frame 2, a plurality of second mounting members 27 is spaced apart from each other in the length direction of the air outlet frame 2, and the plurality of second mounting members 27 is in one-to-one correspondence to the plurality of the first mounting members 26. Thus, a plurality of louvers 200 may be provided in the air outlet frame 2, thereby better adjusting the air flow direction.

Figure 24:
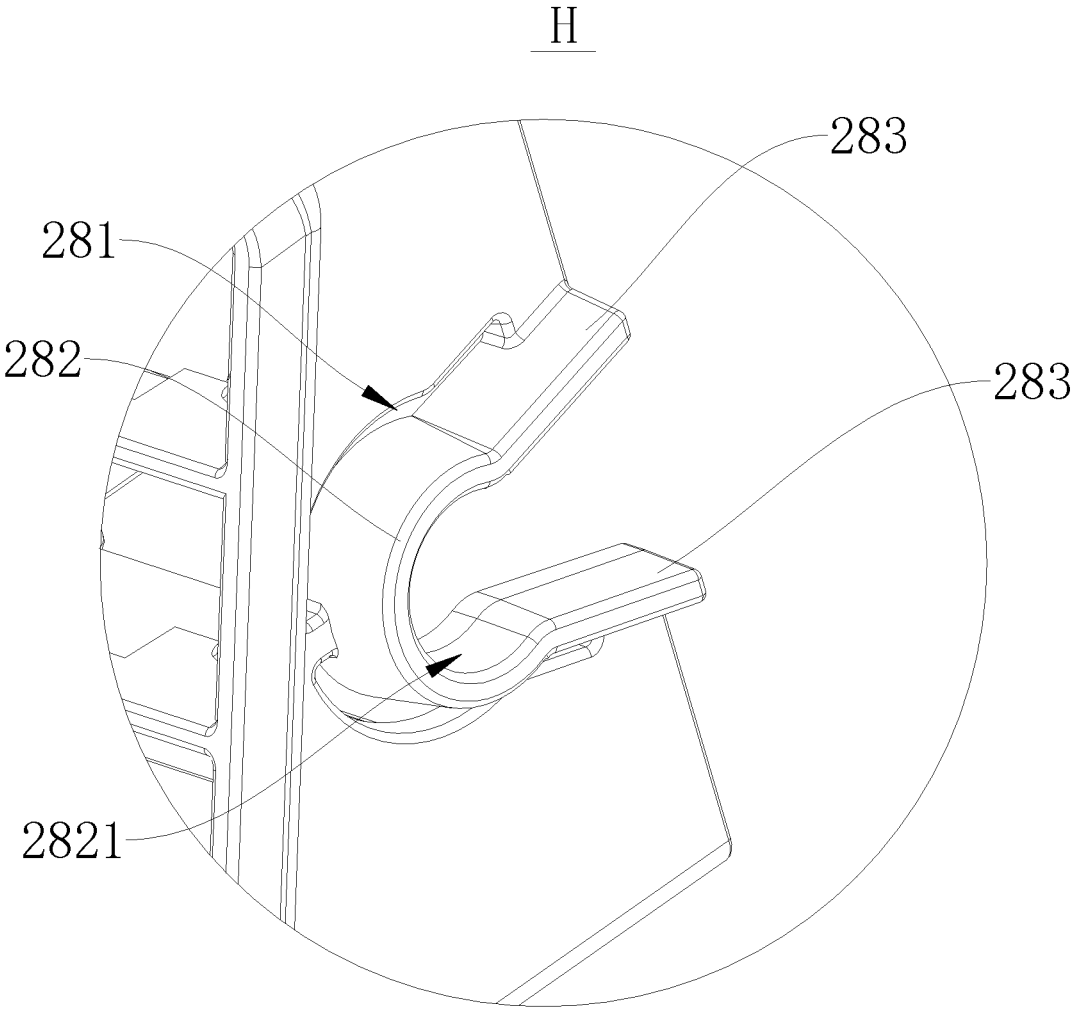
FIG. 24 is an enlarged view of part H in FIG. 22.
Figure 25:
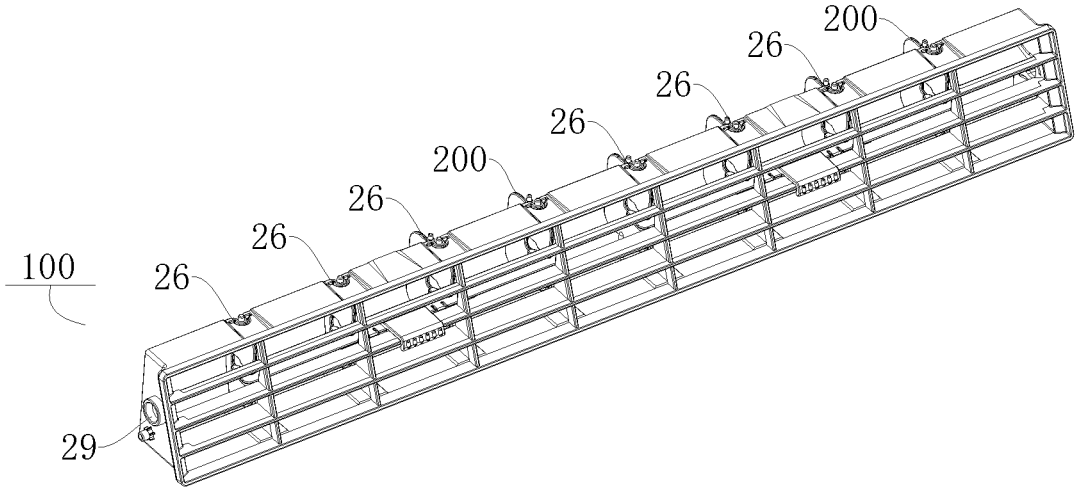
FIG. 25 is a perspective view of the other air outlet frame assembly consistent with embodiments of the present application from another direction.

According to some embodiments of the present application, as shown in FIGS. 22 and 25, two ends of the air outlet frame 2 in the length direction are provided with a third mounting member 28 and a fourth mounting member 29 configured to mount the air outlet frame 2 respectively. As shown in FIG. 24, the third mounting member 28 includes a second notch 281 and a mounting batten 282 located in the second notch 281, the second notch 281 is located at an air inlet end of the air outlet frame 2, the mounting batten 282 is provided in the second notch 281, two ends of the mounting batten 282 in the length direction are connected with two opposite inner side walls of the second notch 281 respectively, the rest part of the mounting batten 282 is spaced apart from the inner wall of the second notch 281, and a rotation hole 2821 configured to accommodate a rotating shaft is formed at the mounting batten 282 and has a mounting opening.

It is understood that only the two ends of the mounting batten 282 in the length direction are fixed at the two opposite inner side walls of the second notch 281, the rest part of the mounting batten 282 is spaced apart from the inner wall of the second notch 281, and a space with good elastic deformation is formed between a part of the mounting battens 282 which are spaced apart from each other and the second notch 281. Thus, an acting force between the mounting batten 282 and the air outlet frame 2 may be reduced, thereby reducing a resistance during the mounting of the air outlet frame 2.

Specifically, when the air outlet frame 2 is mounted, the part of the mounting battens 282 spaced apart from the inner wall of the second notch 281 may tend to displace and deform easily, and at this point, the air outlet frame 2 may be mounted in place with ease. Thus, the difficulty in mounting the air outlet frame 2 may be reduced, thereby improving the assembly efficiency of the air outlet frame 2.

According to some embodiments of the present application, as shown in FIGS. 22 and 24, a width of at least a portion of the rotation hole 2821 adjacent to the mounting opening is decreased gradually. It is understood that the width of the mounting opening of the rotation hole 2821 is relatively small. When the rotating shaft configured to fix the air outlet frame 2 is mounted into the rotation hole 2821, the rotating shaft may be fixed in the mounting opening with a relatively small width, so as to prevent the rotating shaft from moving out of the rotation hole 2821, thereby guaranteeing the mounting reliability of the air outlet frame 2. For example, in some examples of the present application, in a direction from the bottom wall to the mounting opening of the rotation hole 2821, the width of at least a portion adjacent to the mounting opening is decreased gradually.

In some embodiments of the present application, as shown in FIGS. 22 and 24, in a direction toward the mounting opening, the width of the rotation hole 2821 is increased and then decreased gradually. In the direction toward the mounting opening, the inner wall surface of the portion of the rotation hole 2821 with a gradually increasing width may be better fitted with the outer peripheral wall of the rotating shaft. When the rotating shaft is mounted in place, the rotation hole 2821 may better limit and position the rotating shaft.

According to some embodiments of the present application, as shown in FIGS. 22 and 24, a second connection rib 283 is provided between the mounting batten 282 and the inner wall of the second notch 281. It is understood that one end of the second connection rib 283 is connected with the mounting batten 282, and the other end of the second connection rib 283 is connected with the inner wall of the second notch 281. The second connection rib 283 may simplify the connection structure between the mounting batten 282 and the second notch 281, facilitating the reduction in costs. Specifically, in one example of the present application, two second connection ribs 283 are provided, wherein one end of one of the second connection ribs 283 is connected with one end of the mounting batten 282 in the length direction, and the other end of one of the second connection ribs 283 is connected with the inner wall of one side of the second notch 281; one end of the other of the second connection ribs 283 is connected with the other end of the mounting batten 282 in the length direction, and the other end of the other of the second connection ribs 283 is connected with the inner wall of the other side of the second notch 281.

In some embodiments of the present application, the second connection rib 283 and the mounting batten 282 are integrally molded. Therefore, the integral structure may not only ensure the structure and performance stabilities of the second connection rib 283 and the mounting batten 282, but also facilitate the molding and manufacturing, and dispense with unnecessary assembly parts and connection processes, greatly improving an assembly efficiency of the second connection rib 283 and the mounting batten 282 and ensuring the connection reliability of the second connection rib 283 and the mounting batten 282. Further, the integral structure has a high overall strength and stability, is more convenient to assemble and has a longer service life.

Figure 21:
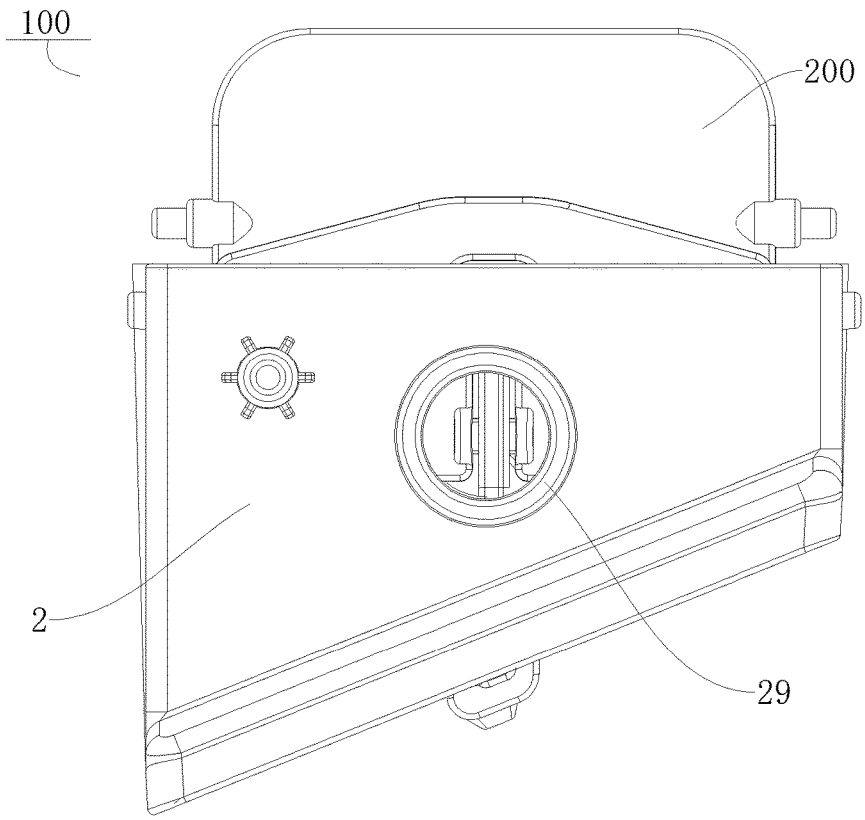
FIG. 21 is a side view of the other air outlet frame assembly consistent with embodiments of the present application.

In some embodiments of the present application, as shown in FIGS. 21 and 25, the fourth mounting member 29 is formed as a fitting hole, thereby reducing the structural complexity of the fourth mounting member 29, decreasing the difficulty in manufacturing the fourth mounting member 29, improving the production efficiency of the fourth mounting member 29, and lowering the production cost of the fourth mounting member 29.

An air outlet frame assembly 100 consistent with embodiments of the present application will be described below with reference to the drawings.

Figure 19:
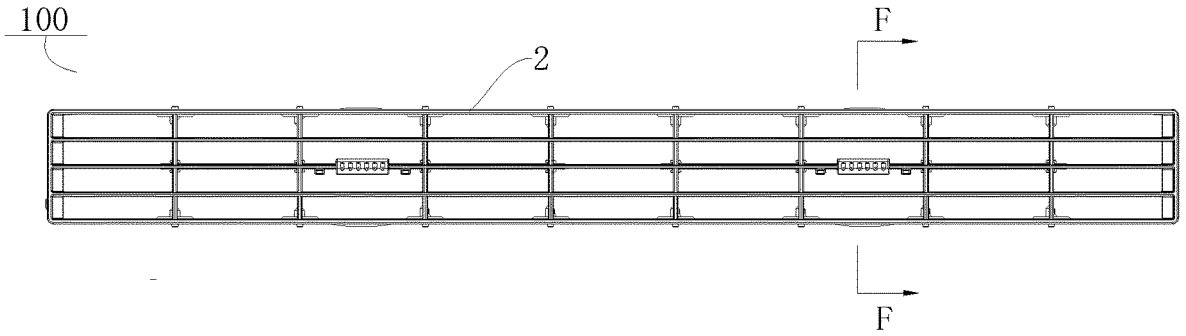
FIG. 19 is a front view of another air outlet frame assembly consistent with embodiments of the present application.
Figure 20:
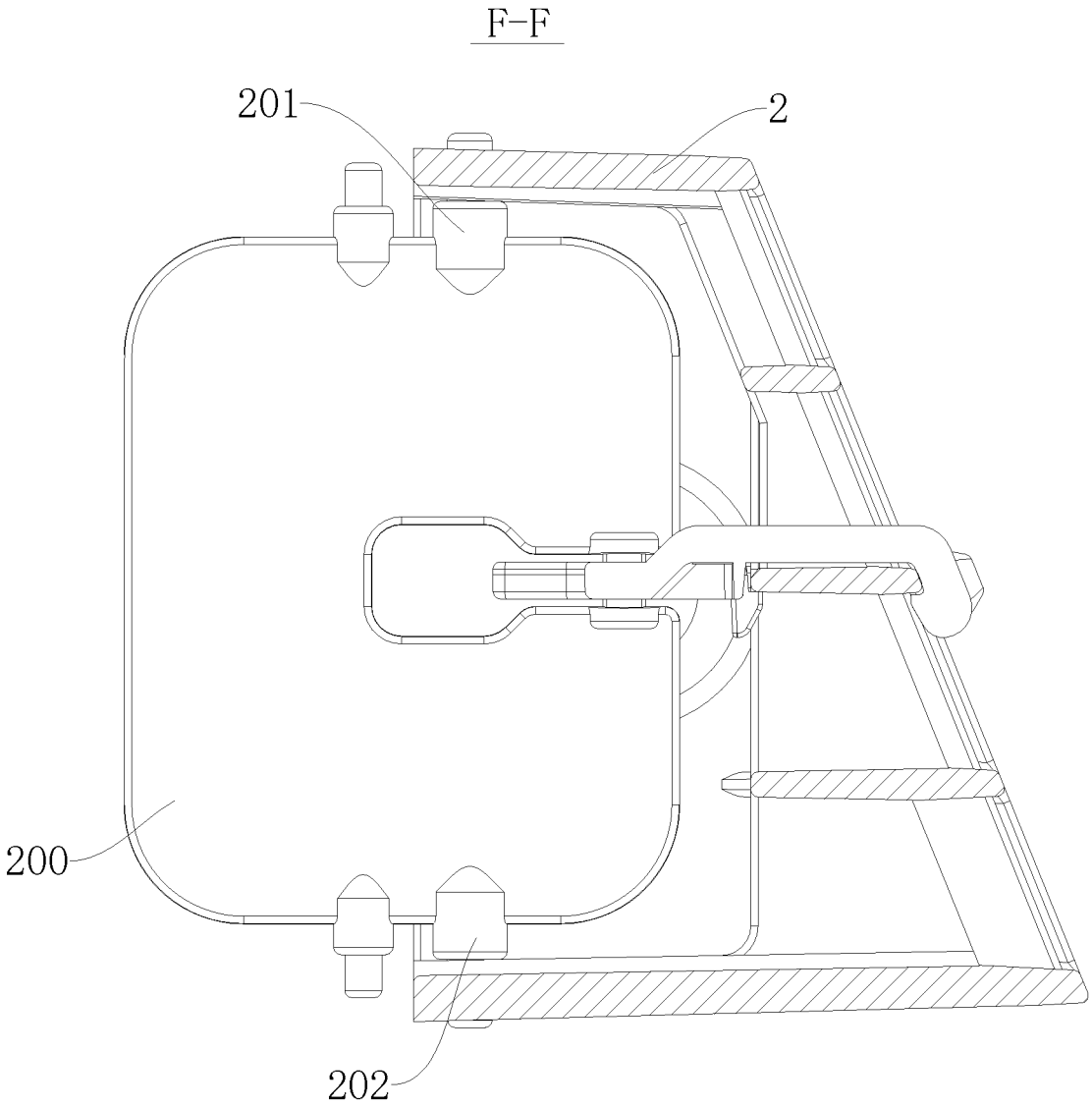
FIG. 20 is an enlarged view of part F-F in FIG. 19.

As shown in FIGS. 19 and 20, the air outlet frame assembly 100 consistent with embodiments of the present application includes: the air outlet frame 2 and the louver 200, wherein the louver 200 has a first rotation member 201 and a second rotation member 202, the first rotation member 201 being located in the mounting hole 2624, the second rotation member 202 being fitted with the second mounting member 27 (referring to FIGS. 15 and 22).

It is understood that the first rotation member 201 may be fitted with the first mounting member 26 and the second rotation member 202 may be fitted with the second mounting member 27, so as to connect and fix the louver 200 and the air outlet frame 2.

Specifically, when the louver 200 is mounted, pressed by the first rotation member 201, the part of the mounting rib 262 spaced apart from the inner wall of the first notch 261 may tend to displace and deform easily, and at this point, the first rotation member 201 may be snapped in the mounting hole 2624 with ease. Similarly, pressed by the second rotation member 202, the part of the mounting rib 262 spaced apart from the inner wall of the first notch 261 may tend to displace and deform easily, and at this point, the second rotation member 202 may be snapped in the mounting hole 2624 with ease. Thus, the difficulty in mounting the louver 200 may be reduced, thereby improving the assembly efficiency of the louver 200.

In the air outlet frame assembly 100 consistent with embodiments of the present application, by providing the mounting rib 262 in the first notch 261 of the air outlet frame 2, forming a mounting hole 2624 configured to mount the louver 200 at the mounting rib 262, connecting two ends of the mounting rib 262 in the length direction with two opposite inner side walls of the first notch 261, and spacing the rest part of the mounting rib 262 apart from the inner wall of the first notch 261, the elasticity of the mounting rib 262 may be improved; when the louver 200 is mounted, pressed by the louver 200, the part of the mounting rib 262 spaced apart from the inner wall of the first notch 261 may tend to displace and deform easily, and at this point, the louver 200 may be snapped in the mounting hole 2624 with ease. Thus, the difficulty in mounting the louver 200 may be reduced, thereby improving the assembly efficiency of the louver 200.

An air conditioner consistent with embodiments of the present application will be described below with reference to the drawings.

The air conditioner consistent with embodiments of the present application includes a housing and the air outlet frame assembly 100, wherein the housing is provided with an air outlet, and the air outlet frame assembly 100 is rotatably provided at the air outlet.

In the air conditioner consistent with embodiments of the present application, by providing the mounting rib 262 in the first notch 261 of the air outlet frame 2, forming a mounting hole 2624 configured to mount the louver 200 at the mounting rib 262, connecting two ends of the mounting rib 262 in the length direction with two opposite inner side walls of the first notch 261, and spacing the rest part of the mounting rib 262 apart from the inner wall of the first notch 261, the elasticity of the mounting rib 262 may be improved; when the louver 200 is mounted, pressed by the louver 200, the part of the mounting rib 262 spaced apart from the inner wall of the first notch 261 may tend to displace and deform easily, and at this point, the louver 200 may be snapped in the mounting hole 2624 with ease. Thus, the difficulty in mounting the louver 200 may be reduced, thereby improving the assembly efficiency of the louver 200.

According to some embodiments of the present application, the two inner side walls of the air outlet in the width direction are provided with a third rotation member and a fourth rotation member, the third rotation member is located in the rotation hole 2821, and the fourth rotation member is fitted with the fourth mounting member 29. It is understood that when the air outlet frame 2 is mounted, pressed by the third rotation member, the part of the mounting batten 282 spaced apart from the inner wall of the second notch 281 may tend to displace and deform easily, and at this point, the third rotation member may be snapped in the rotation hole 2821 with ease. Thus, the difficulty in mounting the air outlet frame 2 may be reduced, thereby improving the assembly efficiency of the air outlet frame 2. Specifically, in one example of the present application, the fourth mounting member 29 is configured as the fitting hole, whereby one end of the air outlet frame 2 is inserted, and the other end of the air outlet frame 2 is snapped. Specifically, when the air outlet frame 2 is mounted, the fourth rotation member may be inserted in the fitting hole, and the third rotation member may be snapped in rotation hole 2821.

In the description of the present disclosure, it should be noted that unless specified or limited otherwise, the terms "mounted," "connected," and "coupled" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations. Furthermore, the feature associated with "first" and "second" may include one or more of this feature explicitly or implicitly. In the description of the present disclosure, "a plurality of" means two or more unless otherwise stated.

In the description of the present specification, reference throughout this specification to "an embodiment," "some embodiments," "exemplary embodiment," "example," "specific example" or "some examples" means that a particular feature, structure, material, or characteristic described in connection with the embodiment or example is included in at least one embodiment or example of the present disclosure. In the specification, the schematic expressions to the above-mentioned terms are not necessarily referring to the same embodiment or example. Furthermore, the described particular features, structures, materials, or characteristics may be combined in any suitable manner in one or more embodiments or examples. Furthermore, those skilled in the art may combine different embodiments or examples and different embodiments or features in the examples described in the specification, without mutual contradictions.

Although embodiments of the present disclosure have been shown and illustrated, it shall be understood by those skilled in the art that various changes, modifications, alternatives and variants without departing from the principle and idea of the present disclosure are acceptable. The scope of the invention is defined by the claims and its equivalents.

What is claimed is:

1. A deflector rod comprising:

a linkage member configured to drive a louver of an air outlet frame to rotate;

a first limiting projection provided at a side of the linkage member; and a shift member connected with the side of the linkage member, and including:

a groove extending between two opposite ends of the shift member; and a second limiting projection provided at a side wall of the groove away from the linkage member;

wherein:

both the second limiting projection and the first limiting projection are spaced apart from a bottom wall of the groove;

the groove, the first limiting projection, and the second limiting projection are configured to clamp an air guide bar of the air outlet frame such that the air guide bar is at least partially located in the groove, between the second limiting projection and the bottom wall of the groove, and between the first limiting projection and the bottom wall of the groove; and the linkage member extends in a length direction of the air guide bar and includes a plurality of accommodation notches spaced apart from each other in a length direction of the linkage member.

2. The deflector rod according to claim 1, wherein the first limiting projection includes a guide slope at an end surface of the first limiting projection distal from an inner side wall of the groove, and the guide slope is inclined away from the linkage member in a direction from an opening of the groove to the bottom wall of the groove.

3. The deflector rod according to claim 1, further comprising:

a connection member including:

a first end connected with the side of the linkage member proximal to the shift member; and a second end extending in a direction away from the bottom wall of the groove and connected with the first limiting projection.

4. The deflector rod according to claim 3, further comprising:

an elastic member;

wherein:

the linkage member includes a recess at the side of the linkage member proximal to the shift member;

a first end of the elastic member in a longitudinal direction of the elastic member is connected with a bottom wall of the recess and a second end of the elastic member is connected with the connection member; and both sides of the elastic member in a width direction of the elastic member are spaced apart from an inner peripheral wall of the recess.

5. The deflector rod according to claim 1, wherein the second limiting projection includes a guide slope at an end surface of the second limiting projection away from an inner side wall of the groove, the guide slope being inclined toward the linkage member in a direction from an opening of the groove to the bottom wall of the groove.

6. The deflector rod according to claim 1, wherein the shift member includes a plurality of shift ribs at an outer side wall of the shift member away from the linkage member, the plurality of shift ribs being spaced apart from each other.

7. An air outlet frame assembly comprising:

an air outlet frame including an air outlet channel and an air guide bar provided in the air outlet channel and extending in a length direction of the air outlet channel; and a louver rotatably provided at the air outlet frame and located upstream of the air guide bar in an air flow direction; and a deflector rod including:

a linkage member configured to drive the louver to rotate, and including a first limiting projection provided at a side of the linkage member, another side of the linkage member being connected with an end of the louver proximal to the air guide bar; and a shift member connected with the side of the linkage member, and including:

a groove extending between two opposite ends of the shift member; and a second limiting projection provided at a side wall of the groove away from the linkage member;

wherein:

both the second limiting projection and the first limiting projection are spaced apart from a bottom wall of the groove;

the air guide bar is at least partially located in the groove, between the first limiting projection and a bottom wall of the groove, and between the second limiting projection and the bottom wall of the groove;

the air outlet channel further includes a plurality of reinforcing rib plates extending in a width direction of the air outlet channel and spaced apart from each other in the length direction of the air outlet channel; and the air guide bar is connected with the plurality of reinforcing rib plates.

8. The air outlet frame assembly according to claim 7, wherein:

the air outlet frame includes a first mounting member and a second mounting member at two ends of the air outlet frame in a width direction of the air outlet frame, respectively, the first mounting member including:

a recess located at an air inlet end of the air outlet frame; and a mounting portion in the recess, two ends of the mounting portion in a longitudinal direction of the mounting portion being connected with two opposite inner side walls of the recess, respectively, a rest part of the mounting portion being spaced apart from an inner wall of the recess, and the mounting portion including a mounting hole configured to mount the louver and including a mounting notch; and the louver includes a first rotation member in the mounting hole and a second rotation member fitted with the second mounting member.

9. The air outlet frame assembly according to claim 8, wherein in a direction toward the mounting notch, the width of the mounting hole is increased gradually and then decreased gradually.

10. The air outlet frame assembly according to claim 8, wherein:

the recess includes:

a first sub-recess formed at the air inlet end of the air inlet frame; and a second sub-recess formed at a bottom wall of the first sub-recess, and a maximum width of the notch sub-recess being less than a minimum width of the first sub-recess;

the mounting portion includes a first segment, a second segment, and a third segment connected successively;

the second segment is opposite to the second sub-recess to form the mounting hole;

one end of the first segment and one end of the third segment are connected with two longitudinal ends of the second segment, respectively, and another end of the first segment and another end of the third segment are connected with opposite inner side walls of the first sub-recess, respectively; and the first segment and the third segment extend in a length direction of the air outlet frame.

11. The air outlet frame assembly according to claim 8, wherein the first mounting member further includes a connection rib between the mounting portion and the inner wall of the recess.

12. The air outlet frame assembly according to claim 8, wherein the first mounting member is one of a plurality of first mounting members of the air outlet frame, the plurality of first mounting members being spaced apart from each other in a length direction of the air outlet frame.

13. The air outlet frame assembly according to claim 8, wherein the first mounting member and the second mounting member have a same structure.

14. The air outlet frame assembly according to claim 8, wherein:

the recess is a first recess;

the air outlet frame further includes a third mounting member and a fourth mounting member at two ends of the air outlet frame in a length direction of the air outlet frame, respectively, the third mounting member including:

a second recess located at the air inlet end of the air outlet frame; and a mounting element is in the second recess, two ends of the mounting element in a longitudinal direction of the mounting element being connected with two opposite inner side walls of the second recess, respectively, a rest part of the mounting element being spaced apart from an inner wall of the second recess, the mounting element including a rotation hole configured to accommodate a rotating shaft, and the rotation hole including a mounting opening.

15. The air outlet frame assembly according to claim 14, wherein the fourth mounting member is formed as a fitting hole.

16. The air outlet frame assembly according to claim 7, wherein the shift member includes a plurality of shift ribs at an outer side wall of the shift member away from the linkage member, the plurality of shift ribs being spaced apart from each other in a length direction of the air guide bar, and each of the shift ribs extending in a direction perpendicular to the length direction of the air guide bar.

17. The air outlet frame assembly according to claim 7, wherein the linkage member extends in a length direction of the air guide bar and includes a plurality of accommodation notches spaced apart from each other in a length direction of the linkage member.

18. An air conditioner comprising:

a housing including an air outlet; and an air outlet frame assembly rotatably provided at the air outlet, the air outlet frame assembly including:

an air outlet frame including an air outlet channel and an air guide bar provided in the air outlet channel and extending in a length direction of the air outlet channel; and a louver rotatably provided at the air outlet frame and located upstream of the air guide bar in an air flow direction; and a deflector rod including:

a linkage member configured to drive the louver to rotate, and including a first limiting projection provided at a side of the linkage member, another side of the linkage member being connected with an end of the louver proximal to the air guide bar; and a shift member connected with the side of the linkage member, and including:

a groove extending between two opposite ends of the shift member; and a second limiting projection provided at a side wall of the groove away from the linkage member;

wherein:

both the second limiting projection and the first limiting projection are spaced apart from a bottom wall of the groove;

the air guide bar is at least partially located in the groove, between the first limiting projection and a bottom wall of the groove, and between the second limiting projection and the bottom wall of the groove;

the air outlet channel further includes a plurality of reinforcing rib plates extending in a width direction of the air outlet channel and spaced apart from each other in the length direction of the air outlet channel; and the air guide bar is connected with the plurality of reinforcing rib plates.

19. The air conditioner according to claim 18, wherein:

the air outlet frame includes:

a first mounting member and a second mounting member at two ends of the air outlet frame in a width direction of the air outlet frame, respectively, the first mounting member including:

a first recess located at an air inlet end of the air outlet frame; and a mounting portion in the first recess, two ends of the mounting portion in a longitudinal direction of the mounting portion being connected with two opposite inner side walls of the first recess, respectively, a rest part of the mounting portion being spaced apart from an inner wall of the first recess, the mounting portion including a mounting hole configured to mount the louver and including a mounting notch; and a third mounting member and a fourth mounting member at two ends of the air outlet frame in a length direction of the air outlet frame, respectively, the third mounting member including:

a second recess located at the air inlet end of the air outlet frame; and a mounting element is in the second recess, two ends of the mounting element in a longitudinal direction of the mounting element being connected with two opposite inner side walls of the second recess, respectively, a rest part of the mounting element being spaced apart from an inner wall of the second recess, the mounting element including a rotation hole configured to accommodate a rotating shaft, and the rotation hole including a mounting opening;

the louver includes a first rotation member in the mounting hole and a second rotation member fitted with the second mounting member;

the housing further includes a third rotation member and a fourth rotation member at two inner side walls of the air outlet in a width direction of the air outlet, respectively, the third rotation member being located in the rotation hole, and the fourth rotation member being fitted with the fourth mounting member.

* * * * *